US005446979A

United States Patent [19]

Sugiyama et al.

[11] Patent Number: 5,446,979

[45] Date of Patent: Sep. 5, 1995

[54] HYDRAULIC CIRCUIT SYSTEM FOR CIVIL ENGINEERING AND CONSTRUCTION MACHINES

[75] Inventors: Genroku Sugiyama, Ibaraki; Toichi Hirata, Ushiku, both of Japan

[73] Assignee: Hitachi Construction Machinery Co., Ltd., Tokyo, Japan

[21] Appl. No.: 142,366

[22] PCT Filed: Apr. 20, 1993

[86] PCT No.: PCT/JP93/00508

§ 371 Date: Nov. 22, 1993

§ 102(e) Date: Nov. 22, 1993

[87] PCT Pub. No.: WO93/21395

PCT Pub. Date: Oct. 28, 1993

[30] Foreign Application Priority Data

Apr. 20, 1992 [JP] Japan ..... 4-099801
Apr. 20, 1992 [JP] Japan ..... 4-099802

[51] Int. Cl.[6] ..... G05D 1/02

[52] U.S. Cl. ..... 37/348; 364/424.07; 60/422; 414/695.5

[58] Field of Search ..... 37/348, 382; 180/197, 180/6.3; 414/694, 695.5; 60/422; 364/424.07

[56] References Cited

U.S. PATENT DOCUMENTS

| | | | |
|---|---|---|---|
| 3,782,478 | 1/1974 | McRay | 172/4.5 |
| 3,841,423 | 10/1974 | Holtkamp et al. | 180/6.3 |
| 3,922,855 | 12/1975 | Bridwell et al. | 414/694 X |
| 4,023,364 | 5/1977 | Bianchetta | 414/694 X |
| 4,030,623 | 6/1977 | Bridwell et al. | 414/694 |
| 4,078,681 | 3/1978 | Field, Jr. | 414/694 |
| 4,336,687 | 6/1982 | Morgan | 60/422 X |
| 4,614,475 | 9/1986 | Tamura et al. | 414/694 |
| 5,179,835 | 1/1993 | Casey et al. | 60/422 X |
| 5,203,678 | 4/1993 | Sugiyama et al. | 417/218 |
| 5,289,679 | 3/1994 | Yasuda | 60/422 |

FOREIGN PATENT DOCUMENTS

| | | |
|---|---|---|
| 53-97285 | 8/1978 | Japan . |
| 2-16416 | 4/1990 | Japan . |
| 2-54861 | 4/1990 | Japan . |
| 3-54077 | 3/1991 | Japan . |

*Primary Examiner*—Randolph A. Reese
*Assistant Examiner*—Victor Batson
*Attorney, Agent, or Firm*—Fay, Sharpe, Beall, Fagan, Minnich & McKee

[57] ABSTRACT

The hydraulic circuit system for civil engineering and construction machines includes a first pressure adjusting device (130) arranged between first variable restrictors (107, 107*a*) of a left traveling directional control valve (47) and a first traveling motor (57) for controlling the pressure downstream of the first variable restrictors to a value corresponding to a first signal pressure and a second pressure adjusting device (133) arranged between second variable restrictors (108, 108*a*) of a right traveling directional control valve (49) and a second traveling motor (58) for controlling the pressure downstream of the second variable restrictors to a value corresponding to a second signal pressure. A shuttle valve (136) detects a higher one of load pressures of the first and second traveling motors as a maximum load pressure. When performing the combined operation in which the first and second traveling motors are driven with at least one of a plurality of working actuators (53–56) simultaneously, signal selection valves (131, 135, 170) are actuated so as to supply the maximum load pressure to the first and second pressure adjusting devices as the first and second signal pressures. Consequently, in a combined operation of traveling and performing other works, a communication circuit (110) is activated along with the operation of a working actuator whereby even if a hydraulic fluid supply circuit (104) of the second traveling directional control valve communicates with a hydraulic fluid supply circuit (103) of a first traveling directional control valve, the differential pressures across the first and second variable restrictors become almost the same, thereby achieving a stable straight traveling.

9 Claims, 12 Drawing Sheets

HYDRAULIC CIRCUIT SYSTEM FOR CIVIL ENGINEERING AND CONSTRUCTION MACHINES

TECHNICAL FIELD

This invention relates to a hydraulic circuit system for civil engineering and construction machines such as a hydraulic excavator, and more particularly to a hydraulic circuit system for civil engineering and construction machines of the type having right and left crawler belts driven by means of right and left traveling motors, which enables a combined operation of traveling and performing other works.

BACKGROUND ART

Prior art hydraulic circuit systems comprise, as disclosed in JP, B, 2-16416, first and second hydraulic pumps, a plurality of hydraulic actuators driven by hydraulic fluid delivered from the first and second hydraulic pumps, a first group of valves connected to a delivery line of the first hydraulic pump for controlling flow rates of hydraulic fluid supplied to the associated hydraulic actuators and a second group of valves connected to an delivery line of the second hydraulic pump for controlling flow rates of hydraulic fluid supplied to the associated hydraulic actuators.

The plurality of hydraulic actuators contains first and second traveling motors for driving right and left crawler belts of, for example, a hydraulic excavator and a plurality of working actuators except the first and second traveling motors including a swing motor of, for example, the hydraulic excavator for driving a swing, an arm cylinder for driving an arm, a boom cylinder for driving a boom and a bucket cylinder for driving a bucket.

The first group of valves includes a first traveling directional control valve for controlling a flow rate of hydraulic fluid supplied to the first traveling motor, and a plurality of first directional control valves for controlling flow rates of hydraulic fluid supplied to part of the plurality of working actuators including, for example, a swing directional control valve, a first arm directional control valve, and a first boom directional control valve, these first directional control valves being connected in tandem to the first traveling directional control valve so as to supply hydraulic fluid from the first hydraulic pump to the associated working actuators with priority over the first traveling motor. The second group of valves includes a plurality of second directional control valves for controlling flow rates of hydraulic fluid supplied to part of the plurality of working actuators including, for example, a second boom directional control valve, a bucket directional control valve and a second arm directional control valve, and a second traveling directional control valve for controlling a flow rate of hydraulic fluid supplied to the second traveling motor, the second traveling directional control valve being connected in tandem to the second directional control valves so as to supply hydraulic fluid from the second hydraulic pump to the second traveling motor with priority over the associated working actuators.

The hydraulic circuit system further contains a circuit for communication of a hydraulic fluid supply circuit of the second traveling directional control valve with a hydraulic fluid supply circuit of the first traveling directional control valve when at least one of a plurality of working actuators except the first and second traveling motors is operated. This communication circuit includes a branch line connecting the delivery line of the second hydraulic pump with an inlet port of the first traveling directional control valve, an on-off valve provided in the branch line for opening and closing thereof, and a check valve provided in the downstream of the on-off valve for preventing a reverse flow of hydraulic fluid. The on-off valve is maintained at its closed position when the first and second directional control valves associate with the working actuators are not activated, and switched to its open position when the first and second directional control valves are activated.

This prior art is intended mainly to improve performance of a combined operation of traveling while operating the swing, boom and arm, simultaneously.

For example, when performing a traveling operation alone, since the on-off valve is maintained at its closed position, all the hydraulic fluid from the first hydraulic pump is supplied to the first traveling motor through the first traveling directional control valve, and all the hydraulic fluid from the second hydraulic pump is supplied to the second traveling motor through the second traveling directional control valve. Consequently, the right and left crawler belts are driven to perform traveling.

If any one of the first directional control valves included in the first group of valves, for example, is operated in such a traveling condition, hydraulic fluid from the first hydraulic pump is preferentially supplied to the first directional control valve and since the on-off valve is switched to its open position, hydraulic fluid from the second hydraulic pump is supplied to the first and second traveling directional control valves. That is, the first and second traveling motors are supplied with hydraulic fluid from only the second hydraulic pump, thereby making it possible to implement the combined operation of traveling and performing other works.

DISCLOSURE OF THE INVENTION

The above described prior art has attained an excellent combined operability of traveling straight on a plane and performing other works. However, since in the combined operation of traveling and performing other works, the first and second traveling directional control valves are connected in parallel, where a load pressure of the first traveling motor is lower than a load pressure of the second traveling motor, all of the hydraulic fluid from the second hydraulic pump flows into the first traveling motor and the operation of the second traveling motor may become unfunctional. For example, when traveling and other works are performed in combination in which during slope climbing, for example, the front actuators (e.g. arm cylinder, boom cylinder) are activated simultaneously with the first and second traveling motors to perform traveling while raising a vehile body with the bucket in contact with the ground surface, only the left crawler belt, for example, may slip and the first traveling motor may idle so as to terminate the operation of the second motor, leading to a failure of slope climbing, when the ground surface is so slippery and the friction between the left crawler belt and the ground surface is small.

It is an object of the present invention to provide a hydraulic circuit system for civil engineering and construction machines which can prevent a traveling failure caused by a difference of load pressures between two traveling motors in the combined operation of traveling and other works.

The object of the present invention is achieved by providing a hydraulic circuit system for civil engineering and construction machines comprising first and second hydraulic pumps a plurality of hydraulic actuators driven by hydraulic fluid delivered from the first and second hydraulic pumps; a first group of valves connected to a delivery line of the first hydraulic pump for controlling flow rates of hydraulic fluid supplied to the associated hydraulic actuators; and a second group of valves connected to a delivery line of the second hydraulic pump for controlling flow rates of hydraulic fluid supplied to the associated hydraulic actuators; the plurality of hydraulic actuators including first and second traveling motors for driving a pair of traveling devices, respectively, and a plurality of working actuators for driving a plurality of working elements, respectively, the first group of valves including a first traveling directional control valve for controlling a flow rate of hydraulic fluid supplied to the first traveling motor and a plurality of first directional control valves for controlling flow rates of hydraulic fluid supplied to at least part of the plurality of working actuators, the plurality of first directional control valves being connected to the first traveling directional control valve so as to supply a hydraulic fluid from the first hydraulic pump to the associated working actuators with a priority over the first traveling motor, the second group of valves including a second traveling directional control valve for controlling a flow rate of hydraulic fluid supplied to the second traveling motor and a plurality of second directional control valves for controlling flow rates of hydraulic fluid supplied to at least part of the plurality of working actuators, the second directional control valve being connected to the plurality of second directional control valves so as to supply hydraulic fluid from the second hydraulic pump to the second traveling motor with a priority over the associated working actuators, the first and second traveling directional control valves having first and second variable restrictors for controlling the flow rate of the hydraulic fluid by changing an open area in accordance with an input amount of first and second operation means, respectively, and further comprising a communication circuit for communicating a hydraulic fluid supply circuit of the second traveling directional control valve with a hydraulic fluid supply circuit of the first traveling directional control valve when at least one of the plurality of working actuators is operated, wherein the hydraulic circuit system further comprises: (a) first pressure adjusting means arranged between the first variable restrictors and the first traveling motor for controlling a pressure downstream of the first variable restrictors to a value corresponding to a first signal pressure; (b) second pressure adjusting means arranged between the second variable restrictors and the second traveling motor for controlling a pressure downstream of the second variable restrictors to a value corresponding to a second signal pressure; (c) pressure selection means for detecting a,higher one of load pressures of the first traveling motor and the second traveling motor as a maximum load pressure and; (d) signal selection means for supplying the maximum load pressure to the first and second pressure adjusting means as the first and second signal pressures when a combined operation is performed in which the first and second traveling motors and at least one of the plurality of working actuators are driven simultaneously.

In the present invention configured above, when performing the combined operation in which the first and second traveling motors are driven simultaneously with at least one of the plurality of working actuators, hydraulic fluid from the first hydraulic pump is supplied to the corresponding working actuator through the first directional control valve of the first group of valves. At the same time, the hydraulic fluid supply circuit of the second traveling directional control valve communicates with the hydraulic fluid supply circuit of the first traveling directional control valve. Thus, hydraulic fluid from the second hydraulic pump is supplied to both the first and second traveling motors. Also, accompanied by the actuations of the first and second traveling motors and working actuators, the signal selection means is actuated so as to pick up a maximum load pressure detected by the pressure selection means, that is, a higher one of load pressures of the first traveling motor and the second traveling motor. This pressure is supplied to the first pressure adjusting means for controlling the pressure downstream of the first variable restrictor and the second pressure adjusting means for controlling the pressure downstream of the second variable restrictor. Consequently, the pressures downstream of the first and second variable restrictors are controlled to mutually equalize the maximum load pressures. The pressures upstream of these first and second variable restrictors are the pressures of hydraulic fluid from the second hydraulic pump and equal to each other.

Therefore, the differential between the pressures upstream and downstream of the first variable restrictor and the differential between the pressures upstream and downstream of the second variable restrictor become equal to each other, so that regardless of the difference of load pressures between the first traveling motor and the second traveling motor, the first traveling motor and the second traveling motor are each supplied with a flow rate of hydraulic fluid corresponding to the opening areas of the first and second variable restrictors. This ensures that even if the load pressure of the first traveling motor happens to become low, the second traveling motor is supplied with hydraulic fluid whereby the second traveling motor is prevented from stopping to avoid the possibility of a traveling failure.

In the hydraulic circuit system, preferably, the signal selection means is adapted to supply said maximum load pressure to the first and second pressure adjusting means as the first and second signal pressures when at least one of the plurality of working actuators is activated. In this case, the signal selection means preferably includes an operation detecting means for detecting at least one of operations of the plurality of working actuators and at least one signal selection valve for supplying the load pressures of the associated actuators to the first and second pressure adjusting means as the first and second signal pressures when no operation is detected by a signal from the operation detecting means and supplying the maximum load pressure to the first and second pressure adjusting means when the operation is detected.

The signal selection means may be adapted to supply the maximum load pressure to the first and second pressure adjusting means as the first and second signal pressures when the open areas of the first and second variable restrictors are larger than predetermined open areas in the vicinity of their maximum values. In this case, preferably, the signal selection means includes at least one signal selection valve for supplying the load pressures of the first and second traveling motors to the first and second pressure adjusting means as the first and second signal pressures when the open areas of the first and second variable restrictors are smaller than predetermined open areas in the vicinity of their maximum values, and supplying the maximum load pressure to the first and second pressure adjusting means as the first and second signal pressures when the open areas of the first and second variable restrictors becomes larger than the predetermined open areas.

In the hydraulic circuit system mentioned above, preferably the first and second pressure adjusting means includes pressure adjusting valves incorporated in the first and second traveling directional control valves, respectively.

Further, preferably, the signal selection means includes first and second signal selection valves provided for the first and second pressure adjusting means, respectively. The signal selection means may include a single signal selection valve provided in common to the first and second pressure adjusting means.

Furthermore, preferably, the first and second pressure adjusting means are incorporated in the first and second traveling directional control valves, respectively, and the signal selection means includes selection passages which open or close dependent upon stroke positions of respective spools of the first and second traveling directional control valve. The signal selection means preferably supplies the maximum load pressure to the first and second pressure adjusting means as the first and second signal pressures when at least one of the plurality of working actuators is activated.

BEST MODE FOR CARRYING OUT THE INVENTION

Embodiments of hydraulic circuit system for civil engineering and construction machines of the present invention will be described with reference to the drawings.

Figure 1:
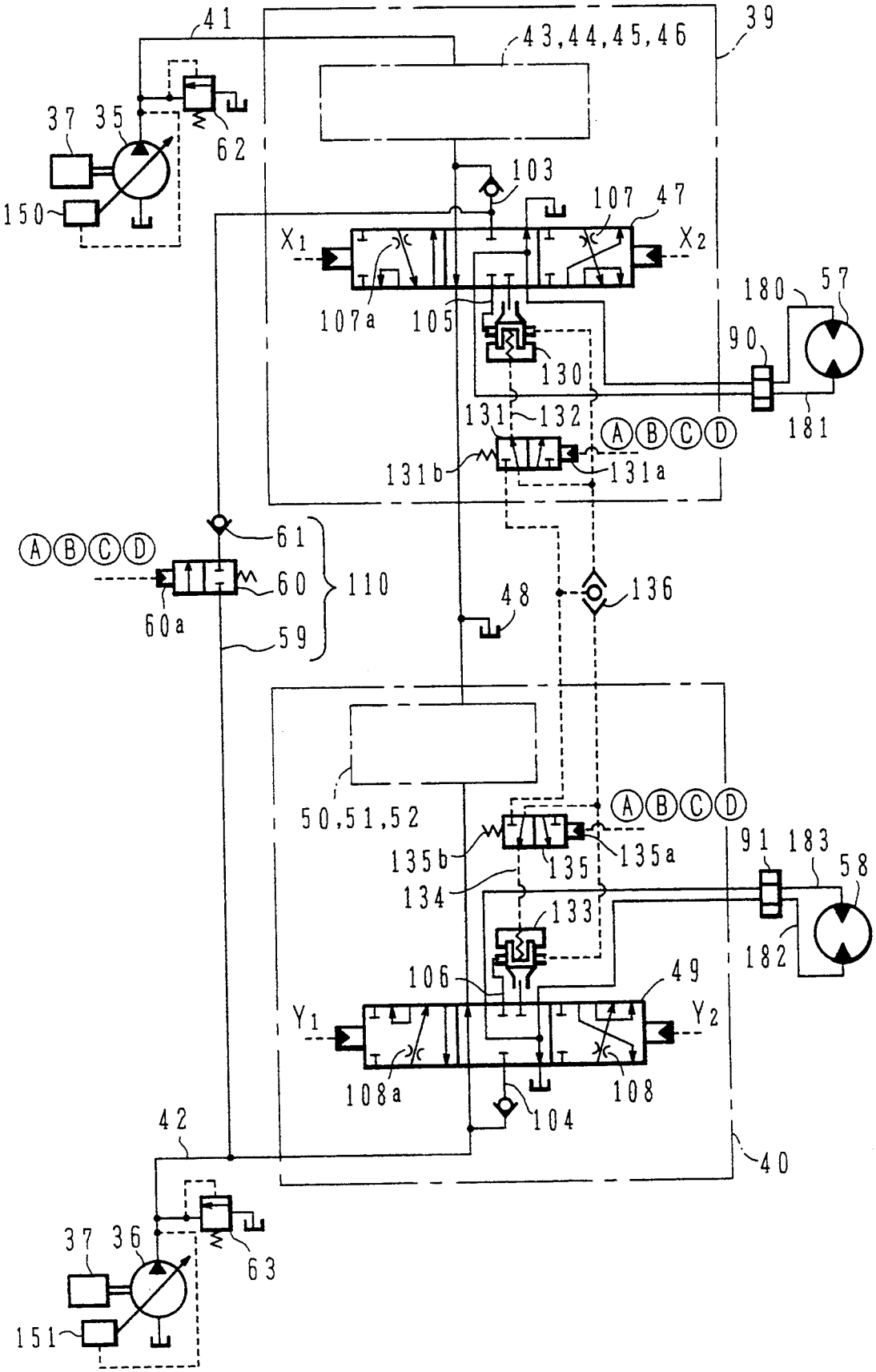
FIG. 1 is a diagram illustrating the configuration of a hydraulic circuit system for civil engineering and construction machines according to the first embodiment of the present invention.
Figure 2:
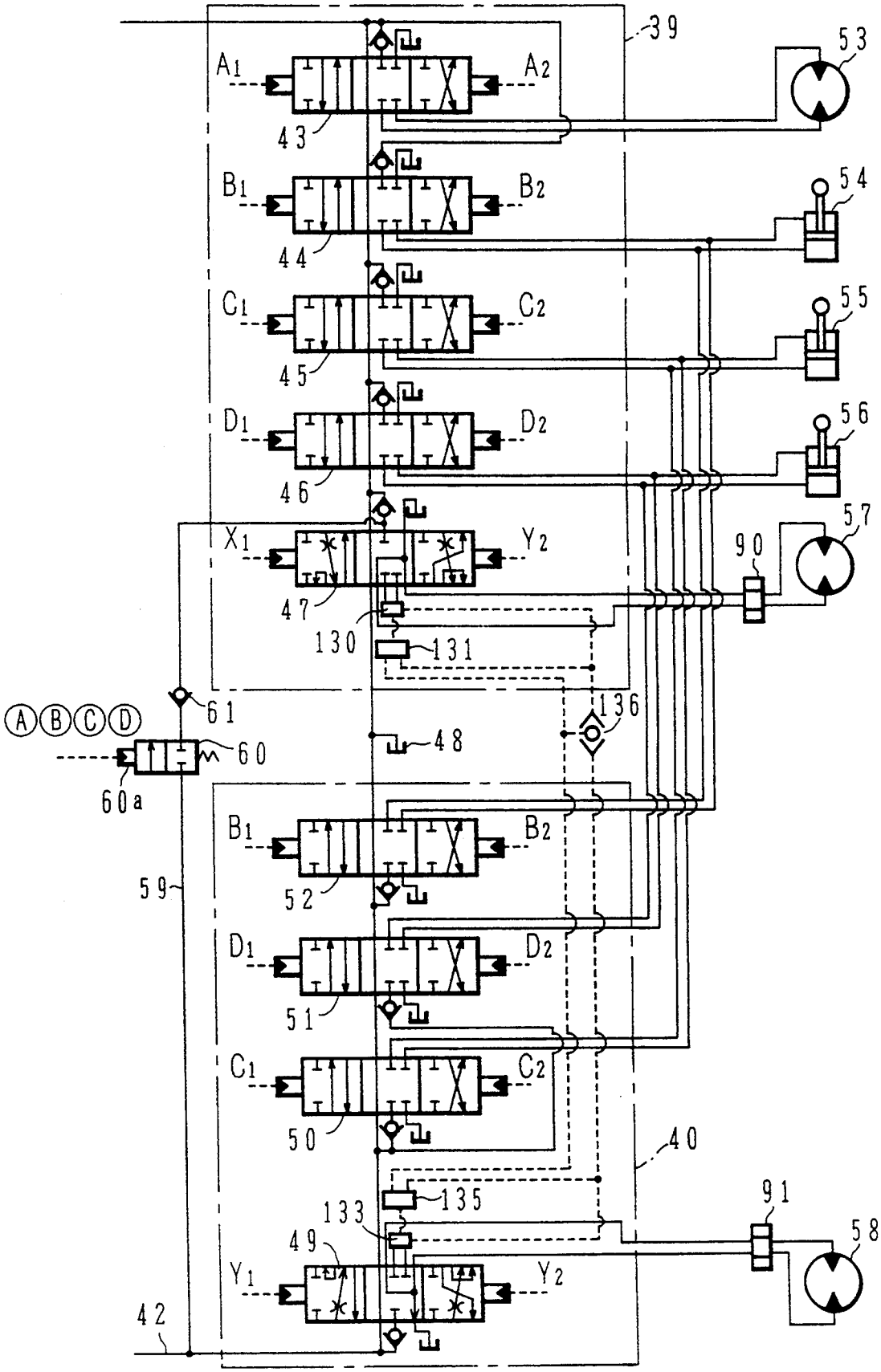
FIG. 2 is a diagram illustrating the details of the first and second groups of valves shown in FIG. 1.

FIGS. 1 and 2 are circuit diagrams showing a configuration of the hydraulic circuit system for a hydraulic excavator of the first embodiment.

Referring to FIGS. 1 and 2, the hydraulic circuit system of the present embodiment includes first and second hydraulic pumps 35, 36 of the variable displacement type. These hydraulic pumps 35, 36 are driven by a common prime mover 37 and their delivery pressures are set by relief valves 62, 63. The first and second hydraulic pumps 35, 36 are swash plate pumps which adjust the pump delivery flow rate by changing the tilting angle (displacement volume) of a swash plate, and are equipped with known input torque limiting regulators 150, 151 which control so as to prevent input power of the hydraulic pumps 35, 36 from exceeding output power of the prime mover 37 by decreasing the swash plate tilting angle to reduce pump delivery flow rate if the pump delivery pressure rises beyond its predetermined value. Preferably, the input torque limiting regulators 150, 151 are made to interlock to perform known total power control.

A delivery line 41 of the first hydraulic pump 35 is connected to a first group of valves 39. The first group of valves 39 has a swing directional control valve 43 in its upstream, and in the downstream, a first arm directional control valve 44, a first boom directional control valve 45, a first bucket directional control valve 46 and a left traveling directional control valve 47, which is a first directional control valve, in this order. The swing directional control valve 43 is connected to a swing motor 53 for driving a swing 200 of a hydraulic excavator shown in FIGS. 3 and 4, the first arm directional control valve 44 is connected to an arm cylinder 54 for driving an arm 201, the first boom directional control valve 45 is connected to a boom cylinder 55 for driving a boom 202, the first bucket directional control valve 46 is connected to a bucket cylinder 56 for driving a bucket 203, the left traveling directional control valve 47 is connected to a left traveling motor 57 for driving a left crawler belt 204.

A delivery line 42 of the second hydraulic pump 36 is connected to a second group of valves 40. The second group of valves 40 has a right traveling directional control valve 49, which is a second directional control valve, in its upstream, and in the downstream, a second boom directional control valve 50, a second bucket directional control valve 51, and a second arm directional control valve 52 in this order. The right traveling directional control valve 49 is connected to a right traveling motor 58 for driving a right crawler belt 205 of the hydraulic excavator shown in FIGS. 3 and 4; the second boom directional control valve 50 is connected to the boom cylinder 55 for driving the boom 202; the second bucket directional control valve 51 is connected to the bucket cylinder 56 for driving the bucket 203; and the second arm directional control valve 52 is connected to the arm cylinder 54 for driving the arm 201.

Figure 3:
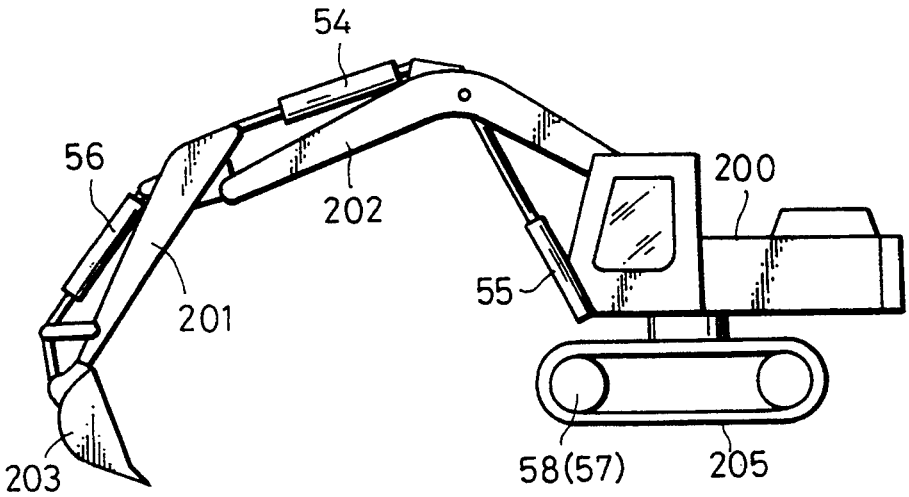
FIG. 3 is a side view of a hydraulic excavator on which the hydraulic circuit system shown in FIG. 1 is to be mounted.
Figure 4:
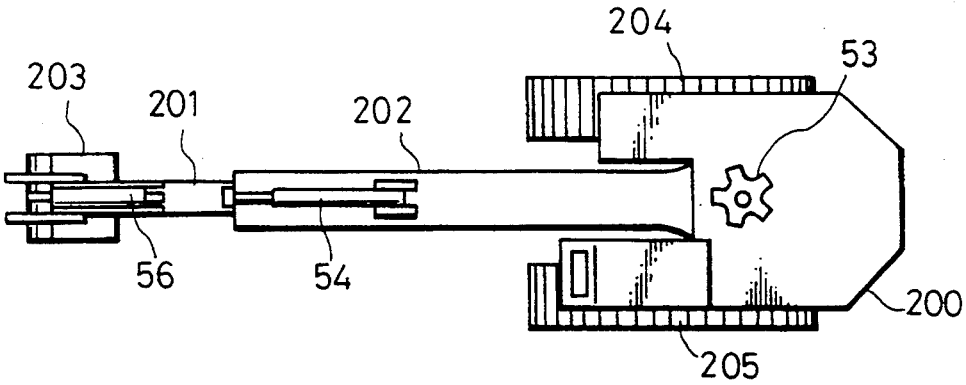
FIG. 4 is a top view of the same hydraulic excavator.

The swing 200, boom 202, arm 201 and bucket 203 shown in FIGS. 3 and 4 configure working elements of the hydraulic excavator, and particularly the boom 202, arm 201 and bucket 203 configure a front mechanism of the hydraulic excavator and the swing motor 53, arm cylinder 54, boom cylinder 55 and bucket cylinder 56 configure working actuators. The swing directional control valve 43, first arm directional control valve 44, first boom directional control valve 55, first bucket directional control valve 46, second boom directional control valve 50, second bucket directional control valve 51 and second arm directional control valve 52 control flow rates of hydraulic fluid supplied to those working actuators. The left traveling directional control valve 47 controls a flow rate of hydraulic fluid supplied to the left traveling motor 57 and the right traveling directional control valve 49 controls a flow rate of hydraulic fluid supplied to the right traveling motor 58.

In the first group of the valves 39, the swing directional control valve 43, first arm directional control valve 44, first boom directional control valve 45 and first bucket directional control valve 46 are connected in tandem to the left traveling directional control valve 47 so as to supply hydraulic fluid from the first hydraulic pump 35 to the associated working actuators 53, 54, 55, 56 with a priority over the left traveling motor 57. In the second group of the valves 40, the right traveling directional control valve 49 is connected in tandem to the second boom directional control valve 50, second bucket directional control valve 51 and second arm directional control valve 52 so as to supply hydraulic fluid from the second hydraulic pump 36 to the right traveling motor 58 with a priority over the associated working actuators 54, 55, 56.

In the first group of the valves 39, the directional control valve 43 and the first arm directional control valve 44 are connected in parallel to each other, and the directional control valves 43, 44 are connected in tandem to the first boom directional control valve 45 and the first bucket directional control valve 46 for allowing hydraulic fluid to be supplied preferntially in this order. In the second group of the valves 40, the second boom directional control valve 50 and the second bucket directional control valve 51 are connected in paralell to each other, and the directional control valves 50, 51 are connected in tandem to the second arm directional control valve 52 for allowing hydraulic fluid to be supplied preferntially in this order.

The delivery line 42 of the second hydraulic pump 36 is connected to an inlet port of the left traveling directional control valve 47 through a branch line 59. This branch line 59 includes an on-off valve 60 which opens and closes this branch line 59 and a check valve 61 provided downstream of this on-off valve to prevent a reverse flow of hydraulic fluid toward the delivery line 42. This on-off valve 60 is adapted to be maintained at its closed position as shown in the drawing when the directional control valves 43, 44, 45, 46 or the directional control valves 50, 51, 52 associated with the working actuators are not operated and switched to its open position when at least one of those directional control valves is actuated.

The above mentioned branch line 59, on-off valve 60 and check valve 61 provides a circuit 110 for communication of the hydraulic fluid supply line 103 of the left traveling directional control valve 47 with the hydraulic fluid supply line 104 of the right traveling directional control valve 49 when at least one of operations of the working actuators (swing motor 53, arm cylinder 54, boom cylinder 55, bucket cylinder 56) except the left traveling motor 57 and the right traveling motor 58 is operated. 48 in the drawing indicates a reservior.

A counter balance valve 90 is provided between the left traveling directional control valve 47 and left traveling motor 57, and a counter balance valve 91 is provided between the right traveling directional control valve 49 and right traveling motor 58.

Figure 5:
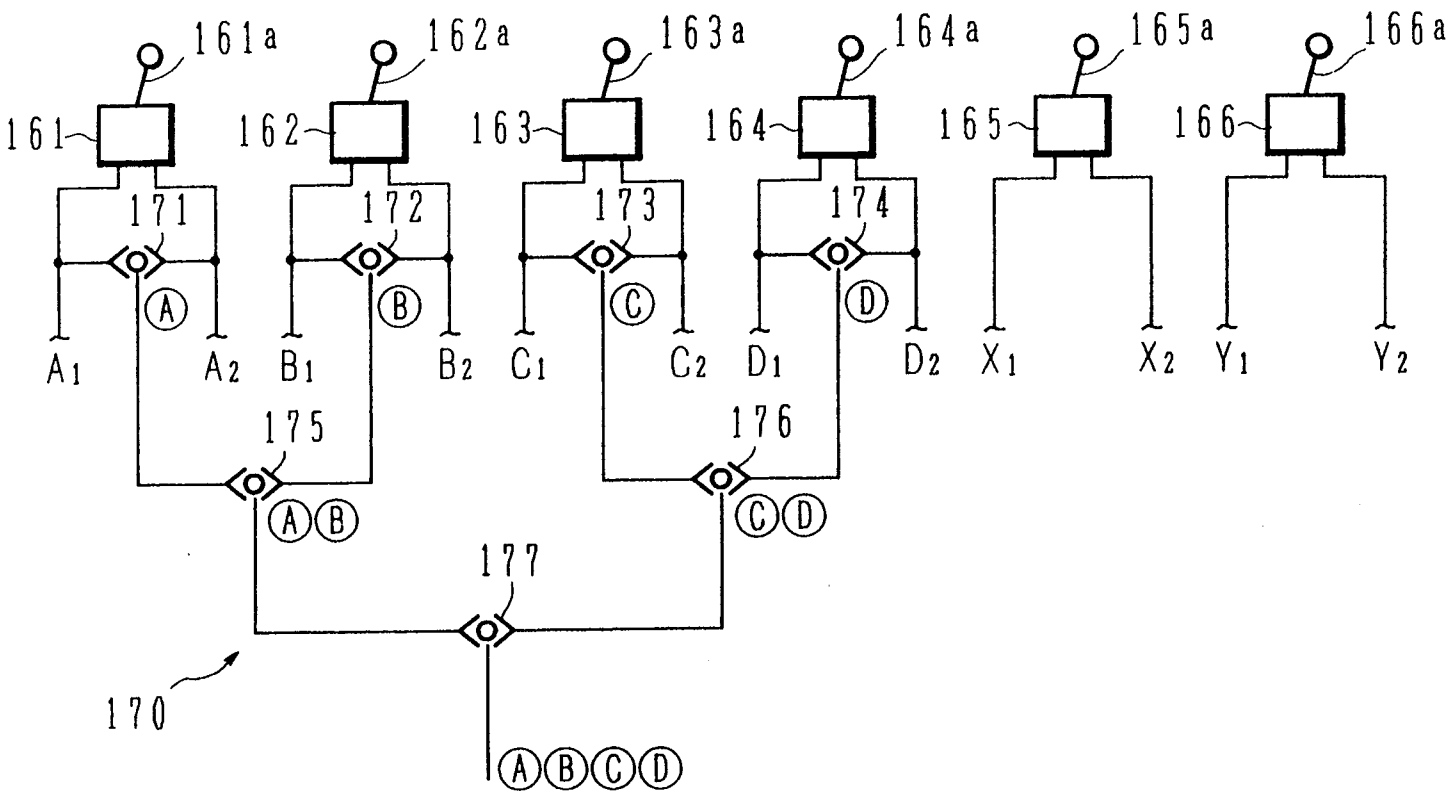
FIG. 5 is a diagram illustrating the configuration of a control lever device for operating a directional control valve of the group of valves shown in FIG. 1 and an operation detecting system for detecting the operation of those directional control valves.

The directional control valves 43 through 47 and 49 through 52 are of the hydraulic pilot operated type and are equipped with control lever devices 161, 162, 163, 164, 165 and 166 shown in FIG. 5 as operation means for actuating these directional control valves to drive the associated actuators. The control lever device 161 is for the swing and generates pilot pressures A1 and A2 corresponding to the operating direction and input amount of a control lever 161*a*. The pilot pressures A1 and A2 are transmitted to the pilot drive section of the swing directional control valve 43. The control lever device 162 is for the arm and generates pilot pressures B1 and B2 corresponding to the operating direction and input amount of a control lever 162*a*. These pilot pressures B1 and B2 are transmitted to the pilot drive sections of the arm directional control valves 44 and 52. The control lever device 163 is for the boom and generates pilot pressures C1 and C2 corresponding to the operating direction and input amount of a control lever 163*a*. These pilot pressures C1 and C2 are transmitted to the pilot drive sections of the boom directional control valves 45 and 50. The control lever device 164 is for the bucket and generates pilot pressures D1 and D2 corresponding to the operating direction and input amount of a control lever 164*a*. These pilot pressures D1 and D2 are transmitted to the pilot drive sections of the bucket directional control valves 46 and 51. The control lever device 165 is for the left side traveling device and generates pilot pressures X1 and X2 corresponding to the operating direction and input amount of a control lever 165*a*. These pilot pressures X1 and X2 are transmitted to the pilot drive section of the left traveling directional control valve 47. The control lever device 166 is for the right side traveling device and generates pilot pressures Y1 and Y2 corresponding to the operating direction and input amount of a control lever 166*a*. These pilot pressures Y1 and Y2 are transmitted to the pilot drive section of the right traveling directional control valve 49.

The on-off valve 60 is a hydraulic pilot operated valve and when operation signal pressures A, B, C and D are detected by an operation detecting means 170, the operation signal pressure is transmitted to a pilot drive section 60*a* of the on-off valve 60, so that the on-off valve 60 is switched from its closed position to its open position. The operation detecting means 170 includes a shuttle valve 171 which detects a pilot pressure A1 or A2 as the operation signal pressure A, shuttle valve 172 which detects a pilot pressure B1 or B2 as the operation signal pressure B, shuttle valve 173 which detects a pilot pressure C1 or C2 as the operation signal pressure C, shuttle valve 174 which detects a pilot pressure D1 or D2 as the operation signal pressure D, shuttle valve 175 which detects a higher one of the operation signal pressures A and B, shuttle valve 176 which detects a higher one of the operation signal pressures C and D, and shuttle valve 177 which detects a higher one of the operation signal pressure A or B and the operation signal pressure C or D.

The left traveling directional control valve 47 has first variable restrictors 107 and 107*a* which changes their open area in accordance with the input amount of the control lever 165*a* to control the flow rate of hydraulic fluid supplied to the left traveling motor 57, and the right traveling directional control valve 49 has second variable restrictors 108 and 108*a* which change their open area in accordance with the input amount of the control lever 166*a* to control the flow rate of hydraulic fluid supplied to the right traveling motor 57. The other directional control valves have similar variable restrictors.

An intermediate load line 105 is located between the first variable restrictors 107 and 107*a* of the left traveling directional control valve 47 and a pair of main lines 180 and 181 for the left traveling motor 57, and the left traveling directional control valve 47 has such a structure that the amount of hydraulic fluid is controlled by the first variable restrictors 107 and 107*a* and is switchably supplied to either the main line 180 or 181 through the load line 105. An intermediate load line 106 is located between the first variable restrictors 108 and 108*a* of the right traveling directional control valve 49 and a pair of main lines 182 and 183 for the right traveling motor 58, and the right traveling directional control valve 49 has such a structure that the amount of hydraulic fluid is controlled by the second variable restrictors 108, and 108*a* which is switchably supplied to either the main line 182 or 183 through the load line 106.

In the first embodiment, a pressure adjusting device 130 is arranged in the load line 105 located between the first variable restrictors 107, 107*a* and the left traveling motor 57. The first pressure adjusting device 130 controls the pressure downstream of the first variable restrictors 107, 107*a* so that it almost coincides with a first signal pressure given through a signal line 132. A second pressure adjusting device 133 is arranged in the load line 106 located between the second variable restrictors 108, 108*a* and the right traveling motor 58. The second pressure adjusting device 133 controls the pressure downstream of the second variable restrictors 108, 108*a* so that it almost coincides with a second signal pressure given through a signal line 134.

This embodiment further includes a pressure selection means such as a shuttle valve 136, which detects a higher one of a pressure generated in the load line 105 of the left traveling directional control valve 47 (load pressure of the left traveling motor 57) and a pressure generated in the load line 106 of the right traveling directional control valve 49 (load pressure of the right traveling motor 58) as a maximum load pressure, and first and second signal selection valves 131, 135 which supply selected ones of the associated self-load pressures and the maximum load pressure to the first and second pressure adjusting devices 130, 133 as the first and second signal pressures, respectively.

The first signal selection valve 131 outputs the associated self-load pressure (load pressure of the left traveling motor 57) as the first signal pressure when any of the control levers 161*a* to 164*a* is not operated and the on-off valve 60 is in its closed position and outputs the maximum load pressure selected by the shuttle valve 136 as the first signal pressure when any of the control levers 161*a* to 164*a* is operated so that the on-off valve 60 is switched to its closed position, that is, when at least one of the directional control valves 43, 44, 45 and 46 or the directional control valves 50, 51 and 52 associated with the working actuators is operated. Likewise, the second signal selection valve 135 outputs the associated self-load pressure (load pressure of the right traveling motor 58) as the second signal pressure when the on-off valve 60 is in the shown closed position and outputs the maximum load pressure selected by the shuttle valve 136 as the second signal pressure when the on-off valve is switched to its closed position.

The first and second signal selection valves 131 and 135 are configured as a hydraulically-operated pilot valve for the purpose mentioned above, and when no operation signal pressure A, B, C or D is detected by the operation detecting means 170 shown in FIG. 5, they are held at positions shown in FIG. 1 by means of the urging of springs 131*b* and 135*b*, and when the operation signal pressures A, B, C and D are detected by the operation detecting means 177 and transmitted to the pilot drive sections 131*a* and 135*a*, they are switched from the positions shown against the urging of the springs 131*a* and 135*c*.

In the embodiment configured as mentioned above, when the control levers 165*a* and 166*a* are operated for a sole operation of forward traveling and the right and left traveling directional control valves 47 and 49 are switched to the right positions shown in FIG. 1, since no control levers 161*a* to 164*a* are operated, no operation signal pressures A, B, C and D are output and the on-off valve 60 is maintained at its closed position. Thus, all the hydraulic fluid from the first hydraulic pump 35 is supplied to the left traveling motor 57 through the left traveling directional control valve 47 and all the hydraulic fluid from the second hydraulic pump 36 is supplied to the right traveling motor 58 through the right traveling directional control valve 49, so that the right and left crawler belts 204 and 205 are driven to perform traveling. At this time, the first and second signal selection valves 131 and 135 are maintained at the positions shown in FIG. 1 since no operation signal pressures A, B, C and D are output, so that the pressure downstream of the first variable restrictors 107 and 107*a* becomes the load pressure of the left traveling motor 57, that is, a self-load pressure, and likewise, the pressure downstream of the second variable restrictors 108 and 108*a* becomes the load pressure of the right traveling motor 58, that is, a self-load pressure. Therefore, the traveling motors 57 and 58 can be driven without being affected by the load pressures. The same operation occurs for a sole operation of traveling backward.

Particularly when the sole traveling operation is such that steering is performed by differing input amounts of the control levers 165*a* and 166*a*, the load pressures of the right and left traveling motors 57 and 58 become different largely. If the load pressure of the higher side (maximum load pressure) is applied to the pressure adjusting device associated with the traveling motor of the lower load pressure side, the pressure downstream of the corresponding variable restrictor is controlled so as to be the maximum load pressure, so that a differential pressure across the pressure adjusting device is enlarged with a remarkable pressure loss being produced. Thus, heat generated due to pressure loss increases so that heat balance is deteriorated thereby reducing the service life of hydraulic devices. In this embodiment, even in such a case, the pressures downstream of the first variable restrictors 107 and 107*a* and the second variable restrictors 108 and 108*a* become their self-load pressures and the differential pressures across the pressure adjusting devices 130 and 133 become almost 0, so that pressure losses of hydraulic fluid passing through the pressure adjusting devices 130 and 133 are hardly barely generated thereby preventing a reduction in the service life of hydraulic devices due to the deterioration of heat balance.

In the above described steering operation, if the pressure downstream of the variable restrictor associated with the traveling motor of the lower load pressure side is controlled so as to become the maximum load pressure, the delivery pressure of the corresponding hydraulic pump must become high. Thus, if known total power control with the input torque limiting regulators 150 and 151 interlocked with each other is performed, the delivery flow rates of the first and second hydraulic pumps 35 and 36 decreases, respectively, thereby possibly causing the traveling speed to drop when steering is performed. In this embodiment, since the pressure downstream of the variable restrictor associated with the traveling motor on the lower load pressure side is maintained at the self-load pressure, the pump delivery pressure does not rise high, and thus the delivery flow rates of the first and second hydraulic pumps 35 and 36 do not drop. Therefore, a drop of traveling speed when steering is performed is prevented to achieve a high traveling performance. When at least one of the control levers 161*a* to 164*a* is operated aiming at a combined operation with the swing 200, arm 201, boom 202 or bucket 203, for example, to actuate the corresponding one of the swing directional control valve 43, arm directional control valve 44, boom directional control valve 45 and bucket directional control valve 46 included in the first group of valves 39, hydraulic fluid from the first hydraulic pump 35 is supplied to the corresponding directional control valve and the associated working actuator is driven and at the same time the corresponding one of the operation signal pressures A, B, C and D is output to the on-off valve 60 and the first and second signal selection valves 131 and 135. Thus, the on-off valve 60 is switched from the closed position shown in FIG. 1 to the open position. With the on-off valve 60 being switched to the open position, part of the hydraulic fluid from the second hydraulic pump 36 is introduced to the left traveling directional control valve 47 through the branch line 59, on-off valve 60 and check valve 61. Then, hydraulic fluid from the second hydraulic pump 36 is introduced to both the left traveling directional control valve 47 and the right traveling directional control valve 49 so as to able both the right and left traveling motors 57 and 58 to be driven. Namely, the right and left traveling motors are supplied with only hydraulic fluid from the second hydraulic pump 36. As a result, a combined operation of traveling and performing other works can be carried out.

Particularly in the first embodiment, when the signal selection valves 131 and 135 are switched from the positions shown in FIG. 1 accompanied by the above described combined operation of traveling and performing other works, the maximum load pressure picked up by the shuttle valve 136 which is a higher one of the pressures generated in the load line 105 of the left traveling motor 57 and the pressure generated in the load line 106 of the right traveling motor 58 is applied to the first pressure adjusting device 130 and the second pressure adjusting device 133 through the signal selection valves 131 and 135, and the signal lines 132 and 134. Consequently, the first pressure adjusting device 130 and the second pressure adjusting device 133 ensure that the pressure downstream of the corresponding first variable restrictor 107 or 107*a* and the second variable restrictor 108 or 108*a* become maximum load pressures. The upstreams of the first variable restrictor 107 or 107*a* and the second variable restrictor 108 or 108*a* are supplied with hydraulic fluid from the second hydraulic pump 36, and therefore the pressure upstream of the first variable restrictor 107 or 107*a* is the same as that of the second variable restrictor 108 or 108*a*. The differences of pressure between the upstream and downstream of the first variable restrictor 107 or 107*a* and the second variable restrictor 108 or 108*a*, that is, the differential pressures across the variable restrictors becomes equal. Therefore, where this differential pressures across the variable restrictors are $\Delta P$, the flow coefficient is K, and the open areas of the left traveling directional control valve 47 and right traveling directional control valve 49 are A1 and A2, the flows Q1 and Q2 passing through the left traveling directional control valve 47 and the right traveling directional control valve 49 are expressed as follows:

$$Q1 = K\ A1\ (\Delta P)^{\frac{1}{2}}$$

$$Q2 = K\ A2\ (\Delta P)^{\frac{1}{2}}$$

If $A1 = A2 = A$ here, $$Q = Q1 = Q2 = K\ A\ (\Delta P)^{\frac{1}{2}}$$

Accordingly, when traveling and other works are performed in combination in which during slope climbing, for example, the front actuators, e.g., the arm cylinder 54 and boom cylinder 55 are activated simultaneously with the first and second traveling motors 57, 58 to perform traveling while keeping the bucket in contact with the ground surface, even if the ground surface is so slippery as to cause, for example, the left crawler belt 205 to slip due to small friction with the ground and the left traveling motor 57 to idle due to the low load pressure, occurrence of the traveling failure can be eliminated in which the hydraulic fluid from the second hydraulic pump 36 is wholly supplied to, for example, the left traveling directional control 47 without being supplied to the right traveling directional control valve 49. That is, the left traveling directional control valve 47 and the right traveling directional control valve 49 are supplied with hydraulic fluid of flow rates corresponding to their open areas so as to realize a stable straight traveling.

Figure 6:
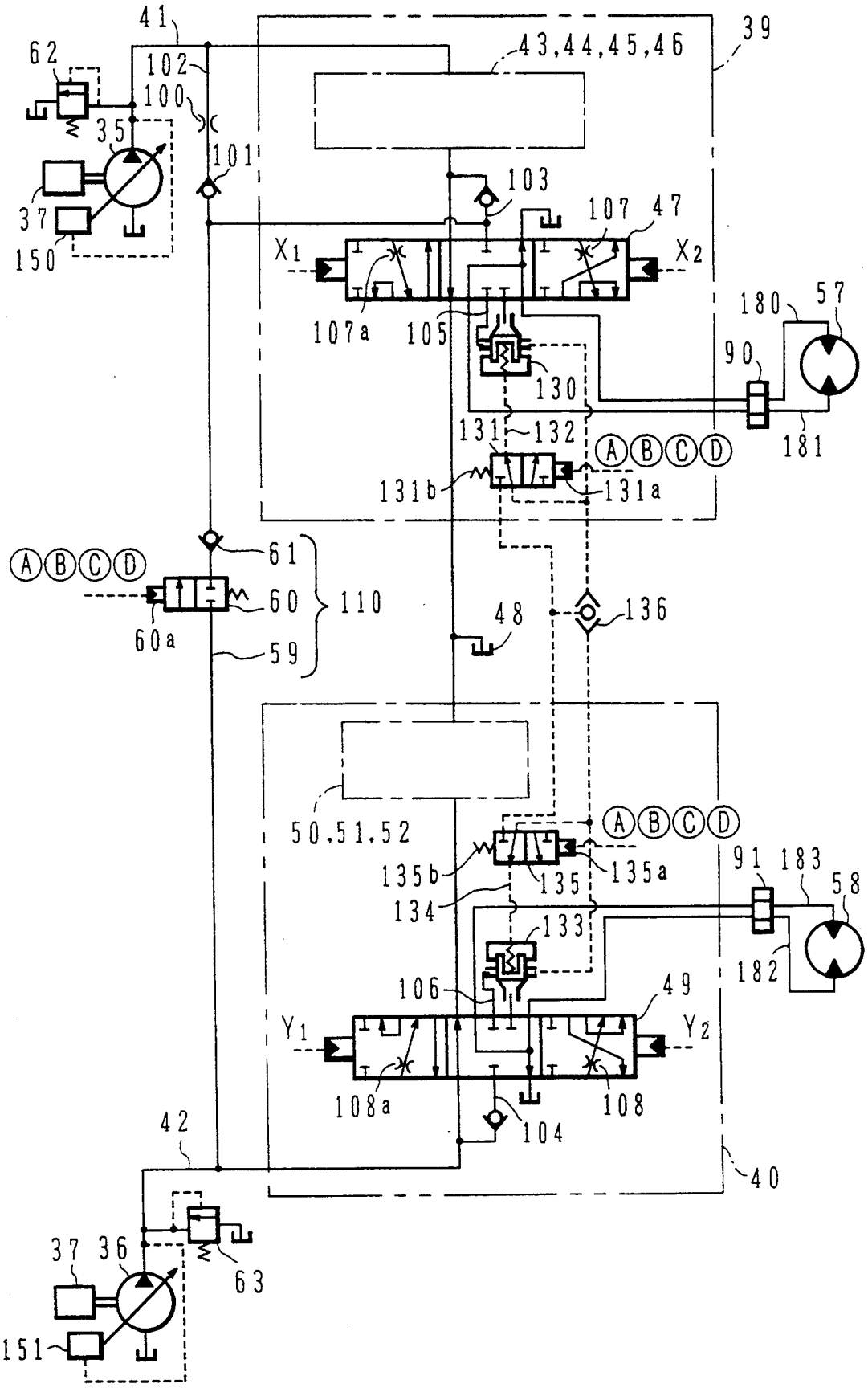
FIG. 6 is a circuit diagram illustrating the configuration of a hydraulic circuit system according to the third embodiment of the present invention.

Referring to FIG. 6, the second embodiment of the present invention will be described. In this drawing, the same members as shown in FIG. 1 are given the same signs and numbers.

The second embodiment shown in FIG. 6 includes another branch line 102 which connects a portion of the delivery line 41 of the first hydraulic pump 35 with the branch line 59 positioned downstream of the check valve 61. The another branch line 102 is equipped with a flow rate control means, for example, a fixed restrictor 100. A check valve 101 for preventing a reverse flow toward the delivery line 41 is provided between the fixed restrictor 100 and a connecting point between the branch line 59 and the other branch line 102. The other configuration is the same as the first embodiment mentioned previously.

The second embodiment configured as described above provides the same effect as the first embodiment mentioned above. Further, unless the branch line 102 and fixed restrictor 100 are provided, when the operation for traveling alone is changed to a combined operation of traveling and performing other works, hydraulic fluid from the first hydraulic pump 35 is also supplied to the associated working actuators. Thus, the flow rate supplied to the left traveling directional control valve 47 positioned downstream of the working actuators decreases as compared with the flow rate up to that time, thereby creating a danger that the traveling speed may drop and a shock may occur. However, since the second embodiment includes the additonal branch line 102 and the fixed restrictor 100 as above-mentioned, when the operation for traveling alone is changed to the combined operation of traveling and performing other works, part of the hydraulic fluid from the first hydraulic pump 35 flows into the left traveling directional control valve 47 through the branch line 102 and the fixed restrictor 100, thereby preventing a sudden drop of traveling speed and shock.

The third embodiment of the present invention is explained by reference to FIGS. 7 and 8. In these drawings, the same members as shown in FIG. 1 are given the same signs and numbers.

Figure 7:
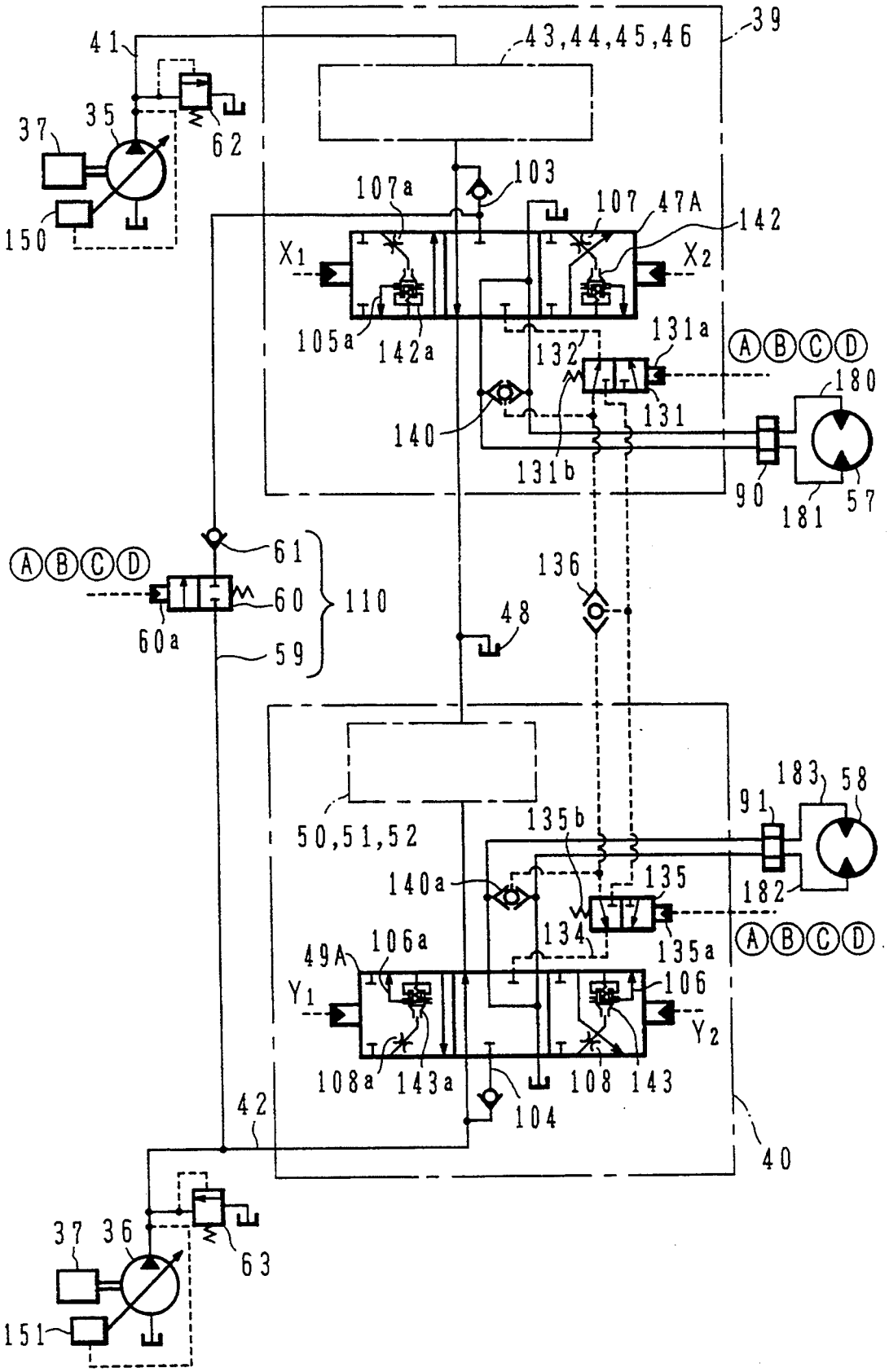
FIG. 7 is a circuit diagram showing the hydraulic circuit system according to the third embodiment of the present invention.

Referring to FIG. 7, the third embodiment includes first pressure adjusting devices 142 and 142*a* incorporated in the left traveling directional control valve 47A correspondingly to the right and left selected positions thereof, and second pressure adjusting devices 143 and 143*a* incorporated in the right traveling directional control valve 49A correspondingly to the right and left selected positions thereof. Additionally, this embodiment includes a shuttle valve 140 which selects one of the load pressures of forward traveling and backward traveling of the left traveling motor 57 and supplying the selected load pressure to a line through which the shuttle valve 136 and the first signal selection valve 131 are connected, and another shuttle valve which selects one of the load pressures of forward traveling and backward traveling of the right traveling motor 58 and supplying the selected load pressure to a line through which the shuttle valve 136 and the second signal selection valve 135 are connected. The other configuration is the same as the first embodiment shown in FIG. 1.

Figure 8:
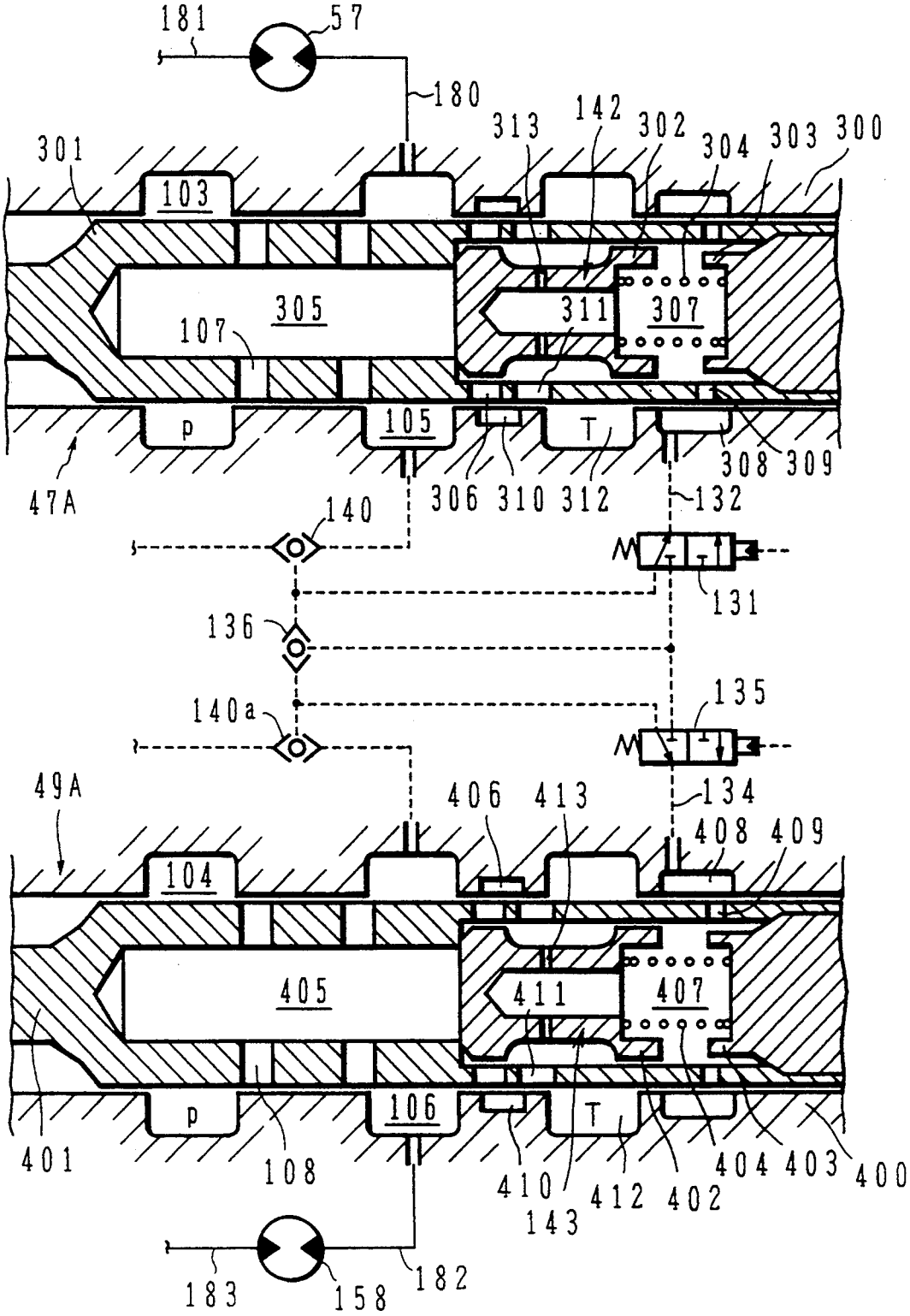
FIG. 8 is a cross-sectional view illustrating major portions of the directional control valve shown in FIG. 7.

FIG. 8 is a view showing the structure of the major parts of the left and right traveling directional control valves 47A, 49A arranged in the third embodiment shown in FIG. 7. To simplify the description, FIG. 8 shows only one of end portions of each of the spools of the left and right traveling directional control valves 47A, 49A.

First, the left traveling directional control valve 47A will be described. The valve 47A comprises a housing (land) 300 forming ports, a spool 301, a valve 302 of the first pressure adjusting device 142 slidable within the spool 301, a stopper 303 fixed on the spool 301 for defining a stroke of the valve 302, and a spring 304. The spool 301 is provided with various variable restrictors (notches) including the first variable restrictor 107. FIG. 8 shows the neutral position where the first variable restrictor 107 provided on the spool 301 is closed. When the spool 301 is moved to the left in FIG. 8 from this position, hydraulic fluid supplied from the hydraulic fluid supply line 103 is introduced into a passage 305 through the first variable restrictor 107, and the hydraulic fluid introduced into the passage 305 forces the valve element 302 of the first pressure adjusting device 142 to the right agains the urging of the spring 304, and then the hydraulic fluid introduced into the passage 305 flows out into the load line 105 through a passage 306.

The first signal pressure output from the first signal selection valve 131 is introduced into a spring chamber 307 of the first pressure adjusting device 142 through a channel 308 and a passage 309. Thus, the pressure downstream of the first variable restrictor 107 is controlled to be such a pressure reflecting the urging of the spring 304 and the first signal pressure. That is, if the urging of the spring is set to be a negligibly small value, when the self-load pressure is introduced into the spring chamber 307 as the first signal pressure, the pressure downstream of the first variable restrictor 107 is controlled to be maintained at the self-load pressure, and when the maximum load pressure selected by the shuttle valve 136 is introduced into the spring chamber 307 as the first signal pressure, the pressure downstream of the first variable restrictor 107 is controlled to be the maximum load pressure.

When the spool 301 returns to its neutral position shown in FIG. 8, the pressure of the load line 105 forces the valve element 302 open, and the pressure is discharged through the passage 306, a channel 310, a passage 311 and a channel 312 into a reservior and the pressure in the spring chamber 307 is discharged into the reservior through a small hole 313, the passage 311 and the passage 312.

The right traveling directional control valve 49A is configured in the same manner as mentioned above. That is, the right traveling directional control valve 49A comprises a housing (land) 400 forming ports, a spool 401, a valve element 402 of the second pressure adjusting device 143 slidable within this spool 401, a stopper 403 fixed on the spool 401 for defining a stroke of the valve 402 and a spring 404. The spool 401 is provided with various variable restrictors (notches) including the second variable restrictor 108. FIG. 7 shows the neutral position where the second variable restrictor 108 provided on the spool 401 is closed. When the spool 401 is moved to the left in FIG. 7, the hydraulic fluid supplied from the hydraulic fluid supply line 104 is introduced into a passage 405 through the second variable restrictor 108, and the hydraulic fluid introduced into the passage 405 forces the valve element 402 of the second pressure adjusting device 143 to the right against the urging of the spring 404, and then the hydraulic fluid introduced into the passage 405 flows out into the load line 106 through a passage 406.

The second signal pressure output from the second signal selection valve 135 is introduced into a spring chamber 407 of the second pressure adjusting device 143 through a channel 408 and a passage 409. Thus, the pressure downstream of the second variable restrictor 108 is controlled to be such a pressure reflecing the urging of the spring 404 and the second signal pressure. That is, if the urging of the spring 404 is set to be a negligibly small value, when the self-load pressure is introduced into the spring chamber 407 as the second signal pressure, the pressure downstream of the second variable restrictor 108 is controlled to be the self-load pressure, and when the maximum load pressure selected in the shuttle valve 136 is introduced into the spring chamber 407 as the first signal pressure, the pressure downstream of the second variable restrictor 108 is controlled to be the maximum load pressure.

When the spool 401 returns to its neutral position shown in FIG. 8, the pressure of the load line 106 forces the valve 402 open, and the pressure is discharged through the passage 406, a channel 410, a passage 411 and a channel 412 into a reservior and pressure in the spring chamber 407 is discharged into the reservior through a small hole 413, the passage 411 and the passage 412.

Thus, in this embodiment also, when the first and second signal selection valves 131 and 135 are switched from the state shown in FIG. 8 upon the combined operation of traveling and performing other works, the maximum load pressure is introduced to both the spring chambers 307 and 407. Consequently, the differential pressure across the first variable restrictor 107 of the left traveling directional control valve 47A becomes equal to the differential pressure across the second variable restrictor 108 of the right traveling directional control valve 49A. Then, the left traveling motor and the right traveling motor are supplied with the same flow rate of hydraulic fluid, thereby realizing a stable straight traveling.

The fourth embodiment of the present invention will be described by reference to FIG. 9. In this drawing, the same members as shown in FIG. 7 are given the same signs and numbers.

Figure 9:
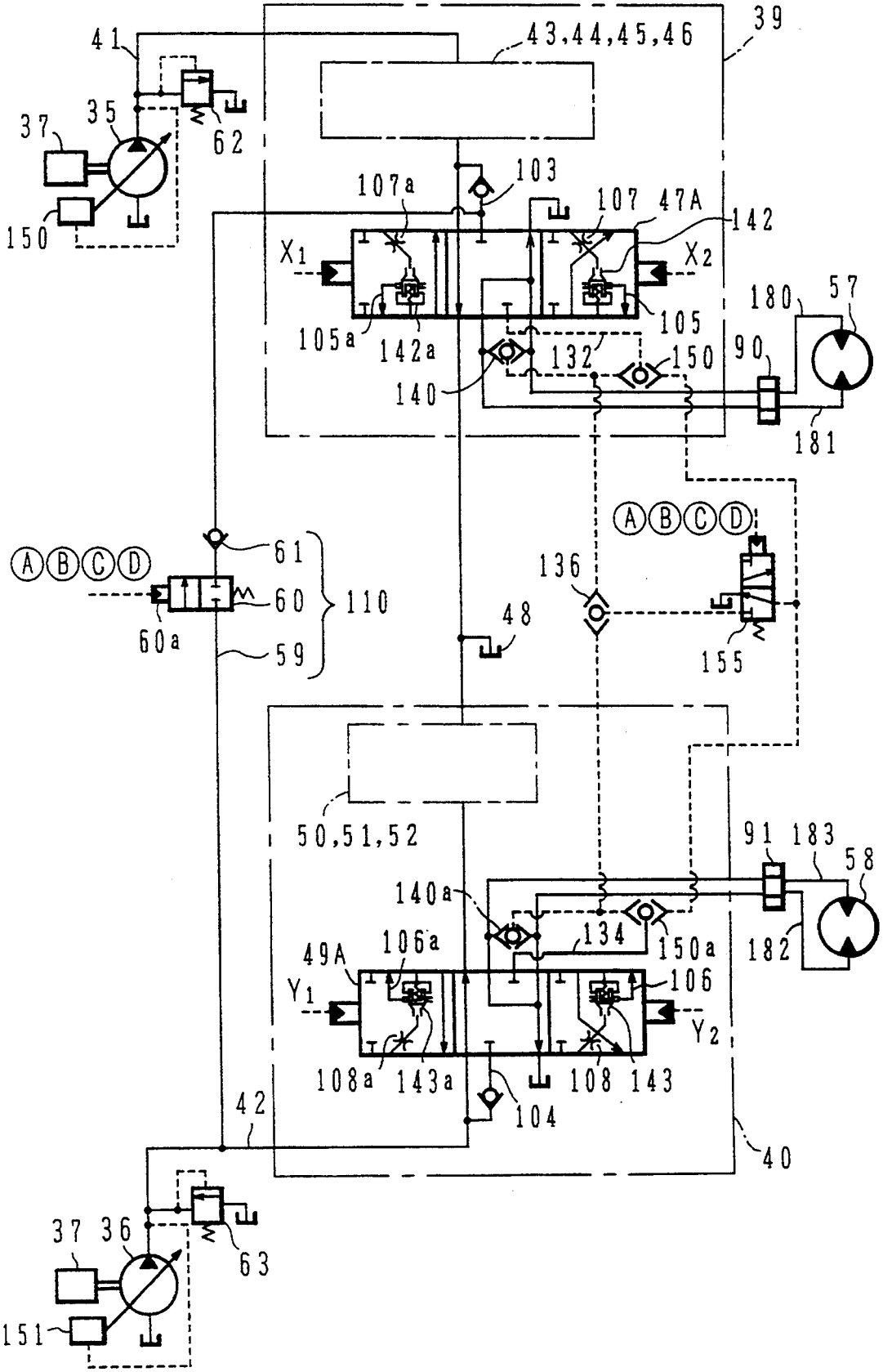
FIG. 9 is a circuit diagram illustrating the configuration of a hydraulic circuit system according to the fourth embodiment of the present invention.

The fourth embodiment shown in FIG. 9 includes a single signal selection valve 155 connected to the shuttle valve 186 instead of the two signal selection valves 131 and 185 in the third embodiment shown in FIG. 7 mentioned previously, and further includes a shuttle valve 150 which selects a higher one of the pressure output from the signal selection valve 155 and the pressure selected by the shuttle valve 140 and supplies the selected pressure to the signal line 132, and a shuttle valve **150*a* which selects a higher one of the pressure output from the signal selection valve 155 and the pressure selected by the shuttle valve 140*a* and supplies the selected pressure to the signal line 134. The signal selection valve 155 is of a hydraulically-operated type, and when no operation signal pressure A, B, C and D are supplied, the valve 155 is maintained at the position shown in the drawing and supplies a reservior pressure to the shuttle valves 150 and 150*a*, and when any of the operation signal pressures A, B, C and D is supplied, the valve 155 is switched from the position shown in the drawing and outputs the maximum load pressure selected by the shuttle valve 136 to the shuttle valves 150 and 150*a***. The other configuration is the same as the third embodiment mentioned previously.

In the fourth embodiment, when the left traveling directional control valve 47A and the right traveling directional control valve 49A are switched to the right positions shown in FIG. 9 for the sole operation of forward traveling, the output pressure of the signal selection valve 155 supplied to the shuttle valves 150 and **150*a* is a reservior pressure since the signal selection valve 155 remains at the position shown in the drawing. The load pressure of the left traveling motor 57 is supplied to the first pressure adjusting device 142 through the shuttle valve 140, shuttle valve 150 and signal line 132, so that the pressure downstream of the first variable restrictor 107 is controlled to be the load pressure of this left traveling motor 57. Thus, the differential pressure across the first variable restrictor 107 is the difference between the pressure of the hydraulic fluid from the first hydraulic pump 35 and the load pressure of the left traveling motor 57. Likewise, the load pressure of the right traveling motor 58 is supplied to the second pressure adjusting device 143 through the shuttle valve 140*a*, shuttle valve 150*a* and signal line 134, so that the pressure downstream of the second variable restrictor 108 is controlled to be the load pressure of this right traveling motor 58. Thus, the differential pressure across the second variable restrictor 108 is the difference between the pressure of the hydraulic fluid from the second hydraulic pump 36 and the load pressure of the right traveling motor 58. In this manner, the traveling motors 57 and 58** can be driven without being affected by the load pressures of each other. The same operation occurs in the sole operation of traveling backward.

When traveling and other works are performed in combination, the signal selection valve 155 is switched from the position shown in the drawing with the operation of any of the working actuators. The load pressure of the left traveling motor 57 is selected by the shuttle valve 140 and supplied to the shuttle valve 136 and the load pressure of the right traveling motor 58 is selected by the shuttle valve **140*a* and supplied to the shuttle valve 136. From the shuttle valve 136, a higher one of the load pressure of the left traveling motor 57 and the load pressure of the right traveling motor is selected as the maximum load pressure and supplied to the first pressure adjusting device 142 through the signal selection valve 155, shuttle valve 150 and signal line 132, and at the same time, the same pressure is supplied to the second pressure adjusting device 143 through the signal selection valve 155, shuttle valve 150*a* and signal line 134, so that the pressures downstream of both the first variable restrictor 107 and the second variable restrictor 108 are controlled so as to be this maximum load pressure. On the other hand, since the on-off valve 60 is switched to the open position, hydraulic fluid from the second hydraulic pump 36 is supplied to both the left traveling directional control valve 47A and the right traveling directional control valve 49A. Thus, the differential pressures across the first variable restrictor 107 and the second variable restrictor 108 both become the differences between the pressure of hydraulic fluid from the second hydraulic pump 36 and the maximum load pressure. Therefore, in the fourth embodiment also, regardless of the difference of the load pressures between the traveling motors 57 and 58, the hydraulic of flow rates corresponding to the open areas of the traveling directional control valves 47A and 49A can be supplied to the right and left traveling motors 57 and 58**, respectively, thereby ensuring a straight traveling in the combined operation of traveling and performing other works like the first embodiment mentioned previously.

The fifth embodiment of the present invention will be described by reference to FIGS. 10 and 11. In these drawings, the same members as shown in FIGS. 1, 5 and 6 are given the same signs and numbers.

Figure 10:
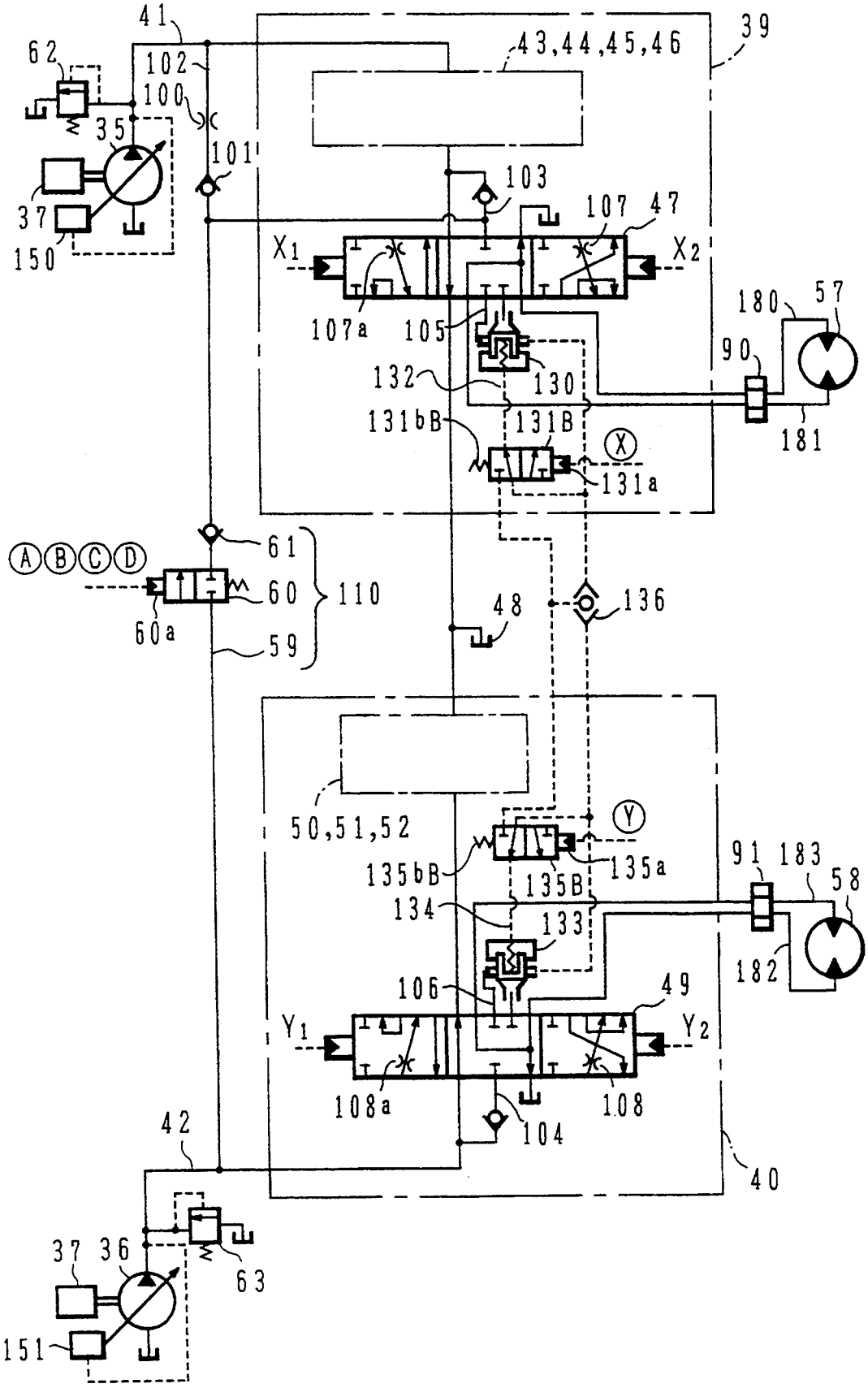
FIG. 10 is a circuit diagram illustrating the configuration of a hydraulic circuit system according to the fifth embodiment of the present invention.
Figure 11:
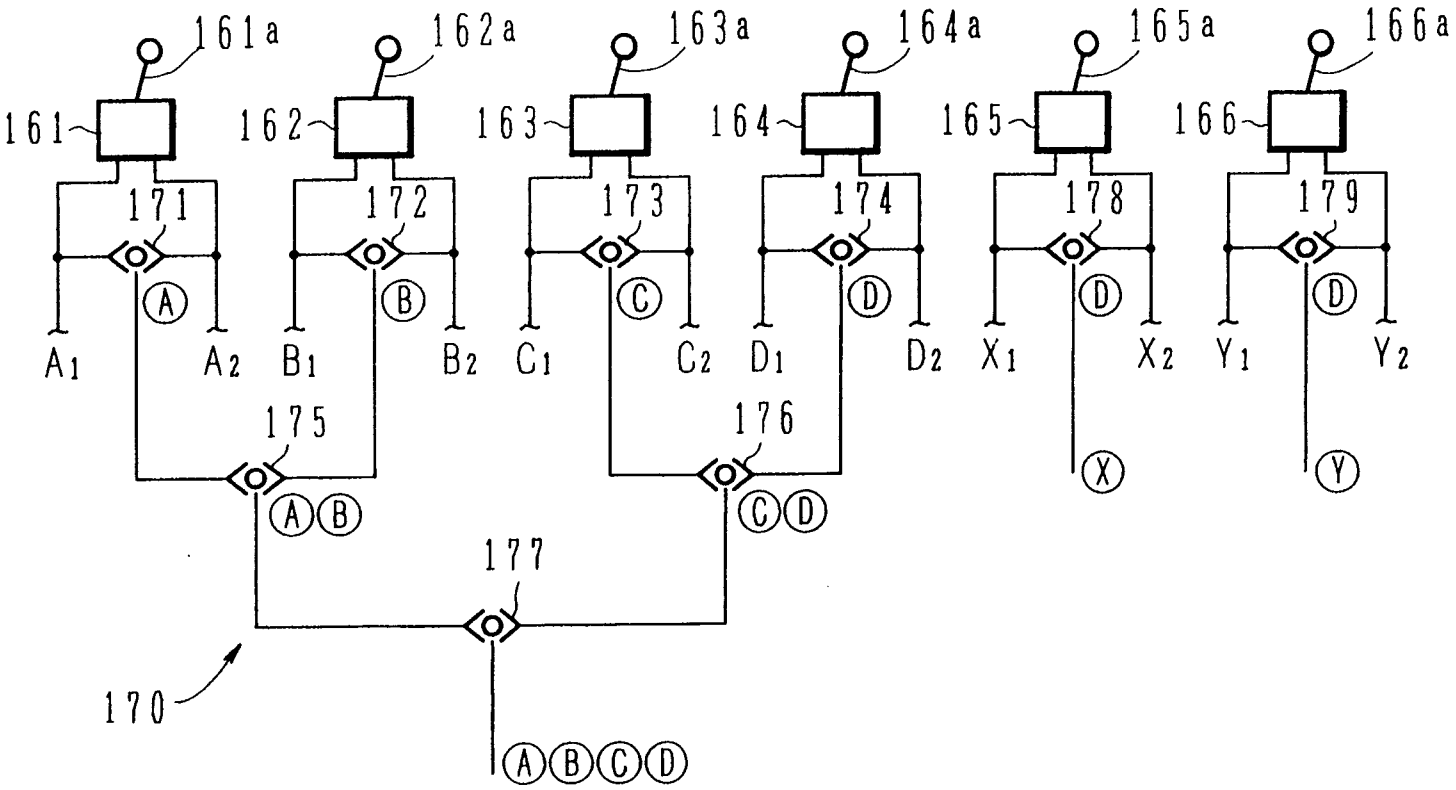
FIG. 11 is a circuit diagram illustrating the configurations of a control lever device for operating a directional control valve of the group of valves shown in FIG. 10 and an operation detecting means for detecting the operation of those directional control valves.

In FIG. 10, the delivery line 41 of the first hydraulic pump 35 is connected with a portion of the first branch line 59 located in the downstream of the check valve 61 via the second branch line 102 equipped with the fixed restrictor 100 and the check valve 101 like the second embodiment. The first and second pressure adjusting devices 130 and 133 are connected with the first and second signal selection valves 131B and 135B like the first embodiment. In this embodiment, however, the first signal selection valve 131B outputs the self-load pressure (load pressure of the left traveling motor 57) as a first signal pressure when the open area of the first variable restrictor 107 or **107*a* included in the left traveling directional control valve 47 is smaller than a predetermined open area set in the vicinity of the maximum value, and outputs the maximum load pressure selected by the shuttle valve 186 as the first signal pressure when the open area of the first variable restrictor 107 or 107***a* increase beyond the predetermined open area set in the vicinity of the maximum value. Likewise, the second signal selection valve 135B outputs the self-load pressure (load pressure of the right traveling motor 58) as a second signal pressure when the open area of the second variable restrictor 108 or 108*a* included in the right traveling directional control valve 49 is smaller than a predetermined open area set in the vicinity of the maximum value, and outputs the maximum load pressure selected by the shuttle valve 136 as the second signal pressure when the open area of the second variable restrictor 108 or 108*a* increases beyond the predetermined open area set in the vicinity of the maximum value.

Namely, the control lever devices 165 and 166 include, as operation detecting means, a shuttle valve 178 which selects a pilot pressure X1 or X2 as an operation signal pressure X, and a shuttle valve 179 which selects a pilot pressure Y1 or Y2 as an operation signal pressure Y, the operation signal pressures X and Y being transmitted to the pilot drive sections 131*a* and 135*a* of the first and second signal selection valves 131B and 135B.

The first signal selection valve 131B includes a spring 131*b*B set so as to maintain the first signal selection valve 131 at a position shown in the drawing against the urging of the operation signal pressure X when the pilot pressure X1 or X2 is on such a level to place the open area of the first variable restrictors 107 or 107*a* included in the left traveling directional control valve 47 below the predetermined open area set in the vicinity of their maximum value, while to switch the first signal selection valve 131 from the position shown in the drawing by the urging of the operation signal pressure X when the pilot pressure X1 or X2 becomes so large as to place the open area of the first variable restrictor 107 or 107*a* beyond the predetermined open area. Likewise, the second signal selection valve 135B iincludes a spring 135*b*B set so as to maintain the second signal selection valve 135B at a position shown in the drawing against the urging of the operation signal pressure Y when the pilot pressure Y1 or Y2 is on such a level to place the open area of the first variable restrictor 108 or 108*a* included in the right traveling directional control valve 49 below the predetermined open area set in the vicinity of the maximum values, while to switch the second signal selection valve 135 from the position shown in the drawing by a force energized by the urging of the operation signal pressure Y when the pilot pressure Y1 or Y2 becomes so large as to place the open area of the first variable restrictor 108 or 108*a* beyond the predetermined open area.

In the embodiment configured as mentioned above, when the control levers 165*a* and 166*a* are operated to switch the right and left traveling directional control valves 47 and 49 to the right position as shown in FIG. 1 for the sole operation of traveling, no operation signal pressures A, B, C or D are output and the on-off valve 60 is maintained at its closed position as no control levers 161*a* to 164*a* are operated. Thus, all the hydraulic fluid from the first hydraulic pump 35 is supplied to the left traveling motor 57 through the left traveling directional control valve 43 and all the hydraulic fluid from the second hydraulic pump 36 is supplied to the right traveling motor 58 through the right traveling directional control valve 49, so that the right and left crawler belts 204 and 205 (see FIGS. 3 and 4) are driven to perform traveling. At this time, when the input amounts of the control levers 165*a* and 166*a* are below their full strokes and the pilot pressures X1 or X2 and Y1 or Y2 are on such a level to keep the open areas of the first and second variable restrictors 107 or 107*a*, and 108 or 108*a* below the predetermined open area in the vicinity of their maximum values, the first and second signal selection valves 131 and 135 are held at the positions shown in FIG. 10, respectively, so that the pressure downstream of the first variable restrictor 107 or 107*a* becomes the load pressure of the left traveling motor 57, that is, the self-load pressure, and likewise, the pressure downstream of the second variable restrictor 108 or 108*a* becomes the load pressure of the right traveling motor 58, that is, the self-load pressure. Consequently, the traveling motors 57 and 58 can be driven without being affected by the load pressures of each other. The same operation occurs in the sole operation of backward traveling.

When steering is performed with differing input amounts of the control levers 165*a* and 166*a*, even if the load pressures of the right and left traveling motors 57 and 58 are largely different, no pressure loss occurs in the pressure adjusting devices 130 and 133 as described above, thereby preventing a reduction in the service life of the hydraulic devices due to deteriorating of heat balance. Additionally, the delivery pressure of the hydraulic pump associated with the traveling motor of the lower pressure side does not rise high, so that a reduction in traveling speed in steering operation is prevented thereby securing a high traveling performance.

When at least one of the swing directional control valve 43, arm directional control valve 44, boom directional control valve 45 and bucket directional control valve 46 included in the first group of valves 39 is operated aiming at a combined operation with the swing 200, arm 201, boom 202, or bucket 203, for example, the hydraulic fluid from the first hydraulic pump 35 is supplied to the corresponding working directional control valve and the associated working actuator is driven and at the same time the corresponding one of the operation signal pressures A, B, C and D is output to the on-off valve 60 for switching thereof from the closed position shown in FIG. 10 to the open position. With the on-off valve being switched to the open position, part of hydraulic fluid from the second hydraulic pump 36 is introduced into the left traveling directional control valve 47 through the first branch line 59, the on-off valve 60 and the check valve 61. Then, the hydraulic fluid from the second hydraulic pump 36 is introduced to both the left traveling directional control valve 47 and the right traveling directional control valve 49 so as to enable the left and right traveling motors 57 and 58 to be driven. Further, upon switching to the combined operation, part of hydraulic fluid from the first hydraulic pump 35 is supplied to the left traveling directional control valve 47 through the second branch line 102, fixed restrictor 100 and check valve 101, thereby preventing a shock due to a sudden decrease in the flow rate supplied to the left traveling directional control valve 47.

Particularly in this fifth embodiment, when the control levers 165*a* and 166*a* are operated up to their full strokes to realize traveling in the combined operation of traveling and performing other works as described above, the pilot pressures X1 or X2 and Y1 or Y2 become so large as to place the open areas of the first and second variable restrictors 107 or 107*a* and 108 or 108*a* beyond the predetermined open area set in the vicinity of their maximum values, so that the first and second signal selection valves 131 and 135 are switched from the position shown in FIG. 10. Generally, in the combined operation of traveling and performing other works, the control levers 165*a* and 166*a* are assumed to be operated up to their full strokes or the strokes approximate thereto, so that the open areas of the first and second variable restrictors 107 or, 107*a* and 108 or 108*a* are increased beyond the predetermined open area set in the vicinity of their maximum values.

When the first and second signal selection valves 131, 135 are switched as described above, the maximum load pressure selected by the shuttle valve 136 or a higher one of the pressure generated in the load line 105 of the left traveling motor 57 and the pressure generated in the load line 106 of the right traveling motor 58 is supplied to the first pressure adjusting device 130 and the second pressure adjusting device 133 through the selection valves 131, 135 and the signal lines 132, 134. Then, the first pressure adjusting device 130 and the second pressure adjusting device 133 control the pressures downstream of the first variable restrictor 107 or 107*a* and the second variable restrictor 108 or 108a, respectively, to be the maximum load pressure. At this time, the first variable restrictor 107 or 107*a* and the second variable restrictor 108 or 108*a* are supplied with hydraulic fluid from the second hydraulic pump 36, therefore the pressures upstream of the first variable restrictor 107 or 107*a* and the second variable restrictor 108 or 108*a* are equal to each other. That is, the differences between the upstream and downstream of the first variable restrictor 107 or 107*a* and the second variable restrictor 108 or 108*a*, or differential pressures across those variable restrictors are equal to each other.

Therefore, in the fifth embodiment also, regardless of the difference of load pressure between the traveling motors 57 and 58, the hydraulic of flow rates corresponding to the open areas of the traveling directional control valves 47 and 49 can be supplied to the right and left traveling motors 57 and 58, respectively, thereby ensuring that the machine travels in the combined operation of traveling and performing operations involving other actuators, as in the first embodiment mentioned previously.

Meantime, when the control lever 165*a* and 166*a* are operated at their full stroke, for example, for performing a sole operation of traveling, the first and second signal selection valves 131, 135 are switched from the position shown in FIG. 10, so that the pressures downstream of the first variable restrictor 107 or 107*a* and the second variable restrictor 108 or 108*a* are controlled so as to be the maximum load pressure. As a result, differential pressures across the first and second variable restrictors become almost the same, thereby realizing a stable straight traveling like in the combined operation of traveling and performing other works mentioned above.

The sixth embodiment of the present invention will be described in accordance with FIGS. 12 and 13. In these drawings, the same members as shown in FIGS. 7 and 8 are given the same signs and numbers.

Figure 12:
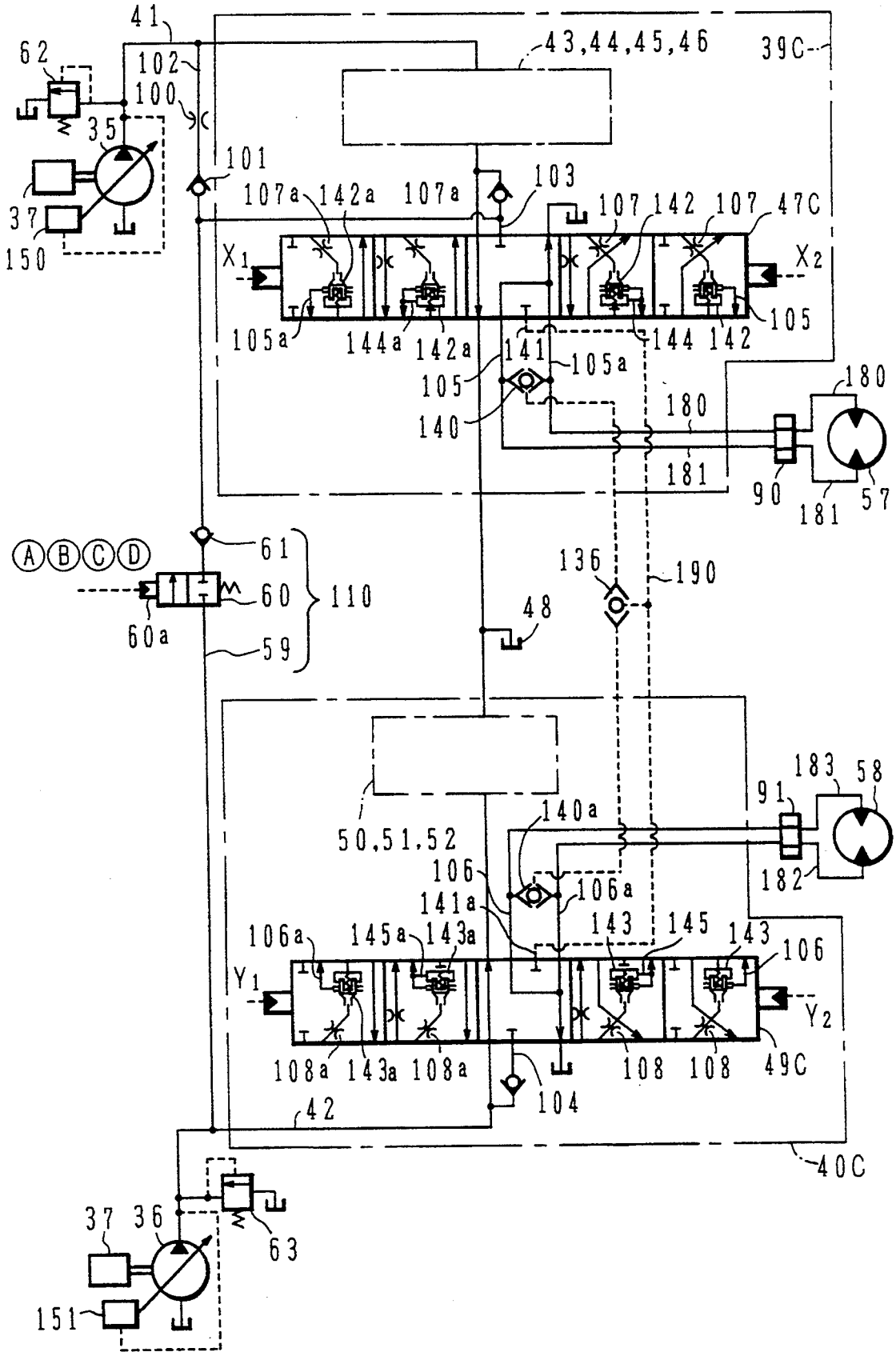
FIG. 12 is a circuit diagram illustrating the configuration of a hydraulic circuit system according to the sixth embodiment of the present invention.

Referring to FIG. 12, in this sixth embodiment, the left traveling directional control valve 47C incorporates the first pressure adjusting devices 142, 142*a* correspondingly to the right and left switching positions of the left traveling directional control valve 47C, and likewise, the right traveling directional control valve 49C incorporates the second pressure adjusting devices 143, 143*a* correspondingly to the right and left switching position of the right traveling directional control valve 49C. The embodiment includes signal selection means for, when the open areas of the first and second variable restrictors 107 or 107*a* and 108 or 108*a* are larger than the predetermined open area set in the vicinity of their maximum values, supplying the maximum load pressure to the first and second pressure adjusting devices 142 or 142*a* and 143 or 143*a* as the first and second signal pressures, and the signal restrictor means comprise the selection passages 141, 141*a* associated with the spools equipped in the traveling directional control valves 47C and 49C. The traveling directional control valves 47C, 49C are configured to have, in addition to their neutral positions, transient operation positions and maximum operation positions in the right and left switching directions. The other configuration is the same as the fourth embodiment mentioned above.

Figure 13:
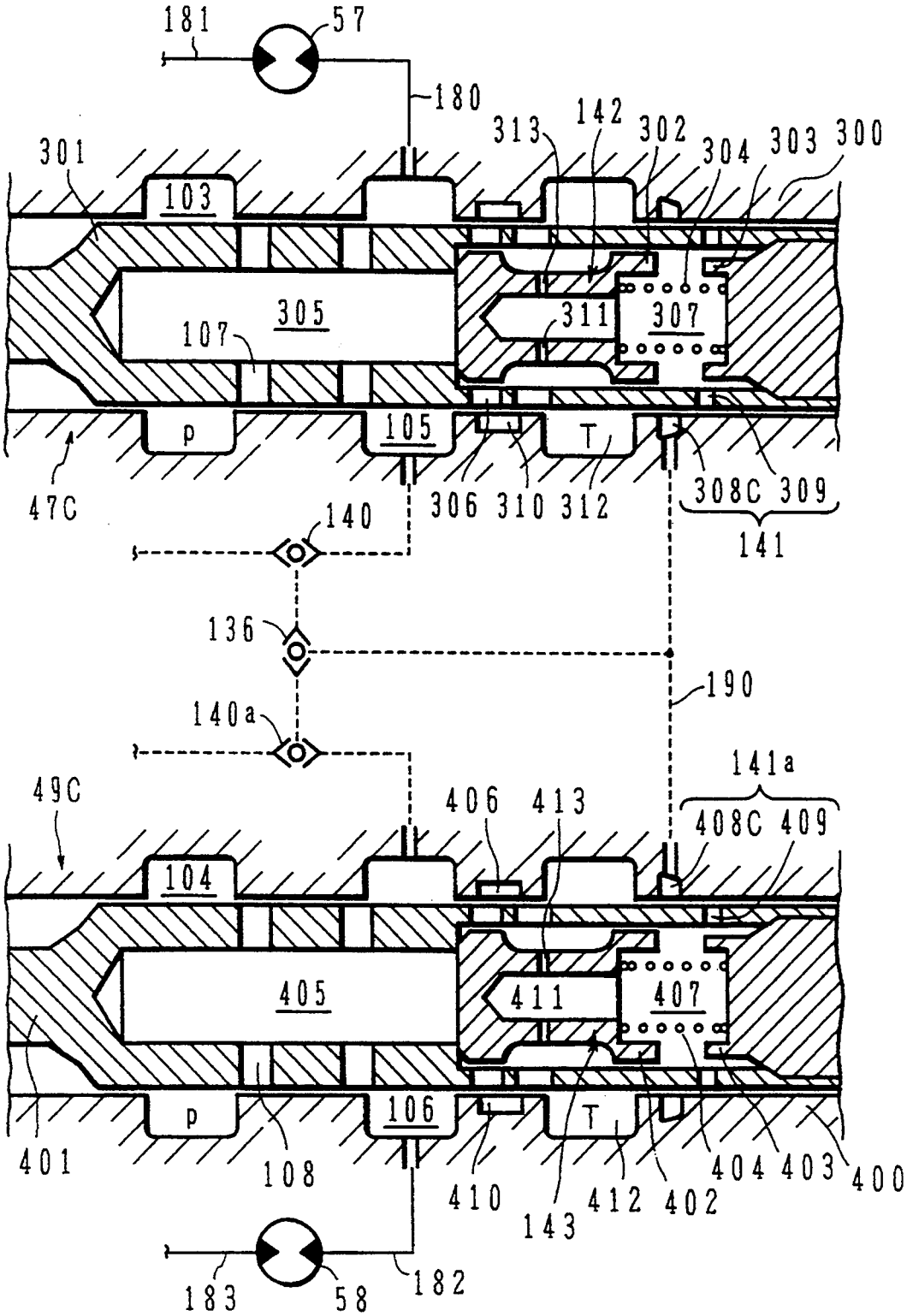
FIG. 13 is a cross-sectional view illustrating major portions of the traveling directional control valve shown in FIG. 12.

FIG. 13 is a view showing the structure of the major parts of the traveling directional control valves 47C, 49C arranged in the sixth embodiment shown in FIG. 12. To simplify the description, FIG. 13 shows only one of end portions of each of the spools of the left and right traveling directional control valves 47C, 49C.

First, the left traveling directional control valve 47C will be described here. The valve 47C comprises a housing (land) 300 forming ports, a spool 301, a valve element 302 of the first pressure adjusting device 142 slidable within the spool 301, a stopper 303 fixed on the spool 301 for defining a stroke of the valve element 302, and a spring 304. The spool 301 is provided with various variable restrictors (notches) including the first variable restrictor 107. FIG. 13 shows its neutral position where the first variable restrictor 107 provided on the spool 301 is closed. When the spool 301 is moved to the left in FIG. 13 from this position, hydraulic fluid supplied from the hydraulic fluid supply line 103 is introduced into the passage 105 connected to the left traveling motor 57 through the first variable restrictor 107 and a passage 305. In this case, in the halfway of operation (half stroke range), hydraulic fluid introduced into the passage 305 forces the valve element 302 of the first pressure adjusting device 142 to the right against the urging of the spring 304, and then the hydraulic fluid introduced into the passage 305 flows out into the load line 105 through a passage 306. The pressure in the load line 105 is introduced into the spring chamber 307 of the first pressure adjusting device 142 through a channel 310, a passage 311 and a small hole 313. Thus, the pressure downstream of the first variable restrictor 107 is controlled so that it reflects the urging of the spring and the pressure in the load line 105. That is, if the urging of the spring 304 is set to be a negligibly small value, the pressure downstream of the first variable restrictor 107 is controlled to be maintained at the load pressure.

The right traveling directional control valve 49 is configured in the same manner as above-mentioned. That is, the right traveling directional control valve 49C comprises a housing (land) 400 forming ports, a spool 401, a valve element 402 of the second pressure adjusting device 143 slidable within this spool 401, a stopper 403 fixed on the spool 401 for defining a stroke of the valve 402 and a spring 404. The spool 401 is provided with various variable restrictors (notches) including the second variable restrictor 108. FIG. 13 shows its neutral position where the second variable restrictor 108 provided on the spool 401 is closed. When the spool 401 is moved to the left in FIG. 13 from this position, the hydraulic fluid supplied from the hydraulic fluid supply line 104 is introduced into the passage 106 connected to the right traveling motor 58 through the second variable restrictor 108 and a passage 405. In this case, in the halfway of operation (half stroke range), the hydraulic fluid introduced into the passage 405 forces the valve element 402 of the second pressure adjusting device 143 to the right against the urging of the spring 404, and then the hydraulic fluid introduced into the passage 405 flows out into the load line 106 through a passage 406. The pressure in the load line 106 is introduced into the spring chamber 407 of the second pressure adjusting device 143 through a channel 410, a passage 411 and a small hole 413. Thus, the pressure downstream of the second variable restrictor 108 is controlled to be such a pressure reflecting the urging of the spring and the pressure in the load line 106. That is, if the urging of the spring 404 is set to be a negligibly small value, the pressure downstream of the second variable restrictor 108 is controlled to be maintained at its load pressure.

As described above, in the half-stroke ranges of the traveling directional control valves 47C, 49C, the pressures in the load lines 105, 106 are supplied to the first pressure adjusting device 142 and the second pressure adjusting device 143, respectively, and the pressures in the passages 305, 405 are controlled to be the pressures in the load lines 105, 106.

In the vicinity of the full strokes in which the open areas of the traveling directional control valves 47C, 49C are maximized, the maximum load pressure relected by the shuttle valve 136 is introduced into the selection passage 141 comprising the channel 308C and the passage 309, and the selection passage 141*a* comprising the channel 408C and the passage 409 through the line 190. In this case, on the side of the left traveling directional control valve 47C, the channel 310 and passage 311 are closed at the same time when the passage 309 is opened to the channel 308C, so that the pressure in the spring chamber 307 of the first pressure adjusting device 142 becomes the above described maximum load pressure. Likewise, on the side of the right traveling directional control valve 49C, the channel 410 and passage 411 are closed at the same time when the passage 409 is opened to the channel 408C, so that the pressure in the spring chamber 407 of the second pressure adjusting device 143 becomes the above described maximum load pressure.

Therefore, even if the load pressures between the left traveling motor 57 and the right traveling motor 58 are different in a combined operation of traveling and performing other works, a higher load pressure is supplied to both the first pressure adjusting device 142 and the second pressure adjusting device 143 as the maximum load pressure. Then, a differential pressure across the first variable restrictor 107 of the left traveling directional control valve 47C becomes equal to a differential pressure across the second variable restrictor 108 of the right traveling directional control valve 49C, so that as mentioned above, hydraulic fluid of flow rates corresponding to the maximum open areas to the left traveling motor 57 and the right traveling motor 58, thereby ensuring a stable straight traveling.

INDUSTRIAL APPLICABILITY

The present invention, configured as mentioned above, provides such effects of preventing a traveling failure caused by a difference of load pressure between two traveling motors in a combined operation of traveling and performing other works to ensure a stable straight traveling, and attaining an excellent traveling operability in a combined operation of traveling and performing other works as compared with prior arts.

What is claimed is:

1. A hydraulic circuit system for civil engineering and construction machines comprising first and second hydraulic pumps; a plurality of hydraulic actuators driven by hydraulic fluid delivered from said first and second hydraulic pumps; a first group of valves connected to a delivery line of said first hydraulic pump for controlling flow rates of hydraulic fluid supplied to the plurality of hydraulic actuators; and a second group of valves connected to a delivery line of said second hydraulic pump for controlling flow rates of hydraulic fluid supplied to the plurality of hydraulic actuators; said plurality of hydraulic actuators including first and second traveling motors for driving a pair of traveling devices, respectively, and a plurality of working actuators for driving a plurality of working elements, respectively, said first group of valves including a first traveling directional control valve for controlling a flow rate of hydraulic fluid supplied to said first traveling motor and a plurality of first directional control valves for controlling flow rates of hydraulic fluid supplied to at least part of said plurality of working actuators, said plurality of first directional control valves being connected to said first traveling directional control valve so as to supply a hydraulic fluid from a hydraulic pump to said plurality of working actuators with a priority over said first traveling motor, said second group of valves including a second traveling directional control valve for controlling a flow rate of hydraulic fluid supplied to said second traveling motor and a plurality of second directional control valves for controlling flow rates of hydraulic fluid supplied to at least part of said plurality of working actuators, said second directional control valve being connected to said plurality of second directional control valves so as to supply hydraulic fluid from said second hydraulic pump to said second traveling motor with a priority over said plurality of working actuators, said first and second traveling directional control valves having first and second variable restrictors for controlling the flow rate of said hydraulic fluid by changing an open area in accordance with an input amount of first and second operation means, respectively, and further comprising a communication circuit for communicating a hydraulic fluid supply circuit of said second traveling directional control valve with a hydraulic fluid supply circuit of said first traveling directional control valve when at least one of said plurality of working actuators is operated, wherein said hydraulic circuit system further comprises:

(a) first pressure adjusting means arranged between said first variable restrictors and said first traveling motor for controlling a pressure downstream of said first variable restrictors to a value corresponding to a first signal pressure;

(b) second pressure adjusting means arranged between said second variable restrictors and said second traveling motor for controlling a pressure downstream of said second variable restrictors to a value corresponding to a second signal pressure;

(c) pressure selection means for detecting a higher one of load pressures of said first traveling motor and said second traveling motor as a maximum load pressure; and (d) signal selection means for supplying said maximum load pressure to said first and second pressure adjusting means as said first and second signal pressures when a combined operation is performed in which said first and second traveling motors and at least one of said plurality of working actuators are driven simultaneously.

2. The hydraulic circuit system for civil engineering and construction machines as defined in claim 1, wherein said signal selection means is adapted to supply said maximum load pressure to said first and second pressure adjusting means as said first and second signal pressures when at least one of said plurality of working actuators is activated.

3. The hydraulic circuit system for civil engineering and construction machines as defined in claim 1, wherein said signal selection means includes an operation detecting means for detecting at least one operation of said plurality of working actuators and at least one signal selection valve for supplying load pressures of said plurality of working actuators to said first and second pressure adjusting means as said first and second signal pressures when no operation is detected by a signal from said operation detecting means and supplying said maximum load pressure to said first and second pressure adjusting means when the operation is detected.

4. The hydraulic circuit system for civil engineering and construction machines as defined in claim 1, wherein said signal selection means is adapted to supply said maximum load pressure to said first and second pressure adjusting means as said first and second signal pressures when the open areas of said first and second variable restrictors are larger than predetermined open areas in the vicinity of their maximum values.

5. The hydraulic circuit system for civil engineering and construction machines as defined in claim 1, wherein said signal selection means includes at least one signal selection valve for supplying the load pressures of said first and second traveling motors to said first and second pressure adjusting means as said first and second signal pressures when the open areas of said first and second variable restrictors are smaller than predetermined open areas provided in the vicinity of their maximum values, and supplying said maximum load pressure to said first and second pressure adjusting means as said first and second signal pressures when the open areas of said first and second variable restrictors becomes larger than said predetermined open areas.

6. The hydraulic circuit system for civil engineering and construction machines as defined in claim 1, wherein said first and second pressure adjusting means includes pressure adjusting valves incorporated in said first and second traveling directional control valves, respectively.

7. The hydraulic circuit system for civil engineering and construction machines as defined in claim 1, wherein said signal selection means includes first and second signal selection valves provided for said first and second pressure adjusting means, respectively.

8. The hydraulic circuit system for civil engineering and construction machines as defined in claim 1, wherein said signal selection means includes a single signal selection valve provided in common to said first and second pressure adjusting means.

9. The hydraulic circuit system for civil engineering and construction machines as defined in claim 1, wherein said first and second pressure adjusting means are incorporated in said first and second traveling directional control valves, respectively, and said signal selection means includes selection passages which open or close dependent upon stroke positions of respective spools of said first and second traveling directional control valves.

* * * * *